US007153621B2

(12) United States Patent
Kojima et al.

(10) Patent No.: US 7,153,621 B2
(45) Date of Patent: Dec. 26, 2006

(54) ELECTROPHOTOGRAPHIC PHOTORECEPTOR AND IMAGE FORMING APPARATUS USING THE PHOTORECEPTOR

(75) Inventors: Narihito Kojima, Numazu (JP); Ryuta Takeichi, Yokohama (JP); Akiyo Namiki, Yokohama (JP); Hiroshi Nagame, Numazu (JP); Yohta Sakon, Numazu (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 11/165,337

(22) Filed: Jun. 24, 2005

(65) Prior Publication Data

US 2005/0238977 A1 Oct. 27, 2005

Related U.S. Application Data

(62) Division of application No. 10/352,075, filed on Jan. 28, 2003, which is a division of application No. 09/796,470, filed on Mar. 2, 2001, now Pat. No. 6,558,862.

(30) Foreign Application Priority Data

Mar. 2, 2000 (JP) ..... 2000-057342
Jan. 26, 2001 (JP) ..... 2001-018537

(51) Int. Cl.
*G03G 21/00* (2006.01)

(52) U.S. Cl. ..... 430/97; 430/56; 430/66; 430/67; 430/125

(58) Field of Classification Search ..... 430/56, 430/66, 67, 58.05, 125, 97; 399/116, 159, 399/346, 347, 177
See application file for complete search history.

(56) References Cited

U.S. PATENT DOCUMENTS

| | | | | |
|---|---|---|---|---|
| 3,552,850 | A | 1/1971 | Royka et al. | |
| 4,957,839 | A | 9/1990 | Rokutanzono et al. | 430/66 |
| 5,008,172 | A | 4/1991 | Rokutanzono et al. | |
| 5,035,973 | A * | 7/1991 | Kaga | 430/125 |
| 5,059,502 | A | 10/1991 | Kojima et al. | 430/66 |
| 5,115,259 | A | 5/1992 | Itoh | |
| 5,430,526 | A | 7/1995 | Ohkubo et al. | |
| 5,480,759 | A | 1/1996 | Kasuya et al. | 430/126 |
| 5,525,447 | A | 6/1996 | Ikuno et al. | 430/67 |
| 5,547,790 | A | 8/1996 | Umeda et al. | |
| 5,656,406 | A | 8/1997 | Ikuno et al. | 430/67 |
| 5,665,500 | A * | 9/1997 | Suzuki | 430/58.5 |
| 5,677,094 | A | 10/1997 | Umeda et al. | |
| 5,804,343 | A | 9/1998 | Umeda et al. | 430/96 |
| 5,840,455 | A | 11/1998 | Ikuno et al. | 430/67 |
| 5,853,935 | A | 12/1998 | Suzuk et al. | 430/83 |
| 5,871,876 | A | 2/1999 | Ikuno et al. | 430/96 |
| 5,910,386 | A | 6/1999 | Yoshinaga et al. | 430/66 |
| 6,014,532 | A | 1/2000 | Takeichi et al. | 399/71 |
| 6,030,733 | A | 2/2000 | Kami et al. | 430/56 |
| 6,060,205 | A | 5/2000 | Takeichi et al. | 430/126 |
| 6,087,055 | A | 7/2000 | Niimi | 430/58.7 |
| 6,118,964 | A | 9/2000 | Kojima et al. | 399/174 |
| 6,122,468 | A | 9/2000 | Sakamota et al. | 399/223 |
| 6,132,911 | A | 10/2000 | Niimi | 430/58.7 |
| 6,151,468 | A | 11/2000 | Kami et al. | 399/159 |
| 6,160,977 | A | 12/2000 | Takeichi et al. | 399/127 |
| 6,203,954 | B1 | 3/2001 | Anayama et al. | 430/67 |
| 6,218,533 | B1 | 4/2001 | Niimi | 540/140 |
| 6,243,552 | B1 * | 6/2001 | Murata | 399/176 |
| 6,326,112 | B1 | 12/2001 | Tamura et al. | 430/58.7 |
| 6,363,237 | B1 | 3/2002 | Nagame et al. | 399/243 |
| 6,521,386 | B1 | 2/2003 | Sakon et al. | 430/58.15 |
| 6,558,862 | B1 | 5/2003 | Kojima et al. | 430/58.05 |
| 6,562,531 | B1 | 5/2003 | Niimi | 430/66 |
| 6,576,388 | B1 | 6/2003 | Sakon et al. | 430/67 |
| 6,641,964 | B1 | 11/2003 | Ikuno et al. | 430/66 |
| 6,790,572 | B1 | 9/2004 | Tamoto et al. | 430/58.05 |
| 2004/0096239 | A1 | 5/2004 | Hosokawa et al. | 399/111 |
| 2004/0131381 | A1 | 7/2004 | Kawasumi et al. | 399/102 |
| 2004/0170446 | A1 | 9/2004 | Nagashima et al. | 399/111 |
| 2004/0184841 | A1 | 9/2004 | Tsuda et al. | 399/258 |
| 2004/0234294 | A1 | 11/2004 | Nagame et al. | 399/159 |
| 2005/0078991 | A1 | 4/2005 | Kimura et al. | 399/350 |

FOREIGN PATENT DOCUMENTS

| | | |
|---|---|---|
| JP | 3-197953 | 8/1991 |
| JP | 5-181299 | 7/1993 |
| JP | 6-83097 | 3/1994 |
| JP | 7-084394 | 3/1995 |
| JP | 7-152217 | 6/1995 |

(Continued)

OTHER PUBLICATIONS

USPTO English-language translation of JP 11-174783 (pub. Jul. 1999).*

(Continued)

*Primary Examiner*—Janis L. Dote
(74) *Attorney, Agent, or Firm*—Oblon, Spivak, McClelland, Maier & Neustadt, P.C.

(57) ABSTRACT

An electrophotographic photoreceptor including a photosensitive layer on an electroconductive substrate, wherein nitrate ion is present on the surface of the photosensitive layer in an amount of from 50 to 300 μg per 1 $m^2$ of the surface of the photosensitive layer when the nitrate ion is determined by an ion chromatographic method. Preferably a material having a fluorine atom and a carbon atom or a fatty acid metal salt such as zinc stearate is further present on the surface of the photosensitive layer such that the F/C ratio is from 0.05 to 0.5 or the Zn/C ratio is from 0.001 to 0.1. An image forming apparatus using the photoreceptor is also provided.

33 Claims, 8 Drawing Sheets

FOREIGN PATENT DOCUMENTS

JP 11-174783 7/1999

OTHER PUBLICATIONS

U.S. Patent & Trademark Office English-Language Translation of JP 5-181299, Published Jul. 1993.
U.S. Patent & Trademark Office English-Language Translation of JP 03-197953, Published Aug. 1991.
Japanese Patent Office Machine-Assisted Translation of JP 11-174783, Published Jul. 1999.
Diamond, A.S., ed., *Hand Book of Imaging Materials*, Marcel Dekker, INC, NY; pp. 160, 161, 495, 396 (1991).
U.S. Appl. No. 10/667,301, filed Sep. 23, 2003, Tsuda et al.
U.S. Appl. No. 11/007,784, filed Dec. 9, 2004, Kondo et al.
U.S. Appl. No. 11/030,307, filed Jan. 7, 2005, Kami et al.
U.S. Appl. No. 11/016,708, filed Dec. 21, 2004, Kitajima et al.

* cited by examiner

ELECTROPHOTOGRAPHIC PHOTORECEPTOR AND IMAGE FORMING APPARATUS USING THE PHOTORECEPTOR

This application is a division of application Ser. No. 10/352,075 filed on Jan. 28, 2003, which is a division of application Ser. No. 09/796,470 filed on Mar. 2, 2001, now U.S. Pat. No. 6,558,862, which was published in English.

BACKGROUND OF THE INVENTION

1. Field of the Invention

The present invention relates to an electrophotographic photoreceptor for use in image forming apparatus such as copiers, facsimile machines, laser printers, and digital plate making machines. In addition, the present invention also relates to an image forming apparatus and process cartridge using the photoreceptor.

2. Discussion of the Background

Electrophotographic image forming methods using a photoreceptor, which are used for copiers, facsimile machines, laser printers, direct digital plate making machines etc., are well known. The image forming methods typically include the following processes:

(1) charging an electrophotographic photoreceptor (charging process);
(2) irradiating the charged photoreceptor with imagewise light to form an electrostatic latent image thereon (light irradiating process);
(3) developing the latent image with a developer including a toner to form a toner image thereon (developing process);
(4) optionally transferring the toner image on an intermediate transfer medium (first transfer process);
(5) transferring the toner image onto a receiving material such as a receiving paper ((second) transfer process);
(6) fixing the toner image to fix the toner image on the receiving material (fixing process); and
(7) cleaning the surface of the photoreceptor (cleaning process).

Currently, image forming apparatus such as copiers, facsimile machines and laser printers tend to be for private use. Therefore, a need exists for miniaturized image forming apparatus. In addition, image forming apparatus having good reliability, i.e., maintenance-free image forming apparatus are also needed.

In addition, currently image scanners and image processing apparatus such as computers are dramatically improved, and therefore it becomes possible to prepare images having high resolution. Therefore, a need exists for image forming apparatus which can stably produce images having high resolution.

Until now, the following photoreceptors are known:

(1) photoreceptors in which a layer including an inorganic photosensitive material such as selenium or amorphous silicon is formed on an electroconductive substrate as a photosensitive layer;
(2) photoreceptors using an organic photosensitive material;
(3) photoreceptors using a combination of an inorganic photosensitive material and an organic photosensitive material; and
(4) photoreceptors using organic photosensitive materials.

Currently, the photoreceptors using organic photosensitive materials are widely used because of having the following advantages over the other photoreceptors:

(1) manufacturing costs are relatively low;
(2) it is relatively easy to design a photoreceptor having a desired property (i.e., the designing flexibility of a photoreceptor can be increased); and
(3) hardly causing environmental pollution.

As the organic photoreceptors, the following photoreceptors are known:

(1) photoreceptors having a photosensitive layer including a photoconductive resin such as polyvinyl carbaozole (PVK) or the like material;
(2) photoreceptors having a photosensitive layer including a charge transfer complex such as a combination of polyvinyl carbaozole (PVK) and2,4,7-trinitrofluorenone (TNF) or the like material;
(3) photoreceptors having a photosensitive layer in which a pigment, such as phthalocyanine or the like, is dispersed in a binder resin; and
(4) photoreceptors having a functionally-separated photosensitive layer including a charge generation material and a charge transport material.

Among these organic photoreceptors, the photoreceptors having a functionally-separated photosensitive layer especially attract attention now.

The mechanism of forming an electrostatic latent image in the functionally-separated photosensitive layer having a charge generation layer and a charge transport layer formed on the charge generation layer is as follows:

(1) when the photosensitive layer is exposed to light after being charged, the light passes through the transparent charge transport layer and then reaches the charge generation layer;
(2) the charge generation material included in the charge generation layer absorbs the light and generates a charge carrier such as electrons and positive holes;
(3) the charge carrier is injected to the charge transport layer and transported through the charge transport layer due to the electric field formed by the charging;
(4) the charge carrier finally reaches the surface of the photosensitive layer and neutralizes the charge thereon, resulting in formation of an electrostatic latent image.

For such functionally-separated photoreceptors, a combination of a charge transport material mainly absorbing light having a wavelength in an ultraviolet region and a charge generation material mainly absorbing light having a wavelength in a visible region is effective and is typically used.

However, it is well known that the functionally-separated organic photoreceptors have a drawback of having poor mechanical and chemical durability. This is because low molecular weight charge transport compounds, which have been typically developed and used as the charge transport material, do not have film forming ability. Therefore, a combination of an inactive polymer and a low molecular weight charge transport compound is typically used for the charge transport layer. However, such a charge transport layer is soft, and therefore has also poor mechanical durability. When such a photoreceptor is repeatedly contacted to various elements such as developer, developing roller, transfer paper, cleaning brush and cleaning blade, the surface of the photoreceptor is easily abraded due to the mechanical stress applied by the elements.

In addition, the organic photoreceptors have another drawback such that they easily react with active substances (i.e., corona discharge induced products) such as ozone and nitrogen oxides (NOx), which are generated when charging the photoreceptors in the charging process essential to electrophotography, resulting in deterioration of charge properties of the photoreceptors and occurrence of undesired images such as tailing and blurring. In particular, in order to prepare a photoreceptor which can produce images having good resolution and which have good durability and stability, this drawback has to be remedied.

In attempting to remedy the former drawback (poor mechanical durability) of such an organic photoreceptor, the following techniques have been disclosed:

(1) a brush is used instead of a blade in the cleaning process, in which the photoreceptor is subjected to the largest mechanical stress, to reduce the mechanical stress; and (2) a lubricant applying device is provided in the vicinity of a photoreceptor, which device applies a lubricant on the surface of the photoreceptor, to decrease the abrasion of the photosensitive layer of the photoreceptor (this technique has been disclosed in Japanese Laid-Open Patent Publications Nos. 6-342236, 8-202226 and 9-81001).

The abrasion can be improved by these techniques to some extent, however, the latter drawback (i.e., poor resistance to ozone and NOx) cannot be remedied. Therefore these techniques are not satisfactory.

In attempting to remedy the latter drawback of the organic photoreceptor, the following techniques have been disclosed:

(1) Contact Charging Methods

The charging methods for charging a photoreceptor are classified into two types, one of which is non-contact charging methods and the other of which is contact charging methods.

Among the non-contact charging methods, a corona discharging method is well known in which a photoreceptor is charged using an electroconductive element, such as wires and plates, which is provided apart from the surface of the photoreceptor and to which a high voltage is applied. This method has an advantage in that the surface of a photoreceptor can be uniformly charged, and therefore the method has been typically used.

On the contrary, in the contact charging methods, a photoreceptor is charged by a charging element, such as brushes, roller-shaped brushes, rollers, blades and belts, which has an appropriate electroconductivity and elasticity and which contacts the surface of the photoreceptor. These methods have been disclosed in Japanese Laid-Open patent Publications Nos. 63-149668 and 7-281503.

The contact charging methods have an advantages over the non-contact charging methods in that the voltage applied to the photoreceptor can be reduced and thereby the amount of generated ozone, which is considered to damage human beings and photoreceptors, can be reduced. Therefore, recently these contact charging methods have widely spread.

(2) Short Range Charging Methods

As intermediate methods between the contact charging methods and non-contact charging methods, short range charging methods in which a DC voltage overlapped with a DC or AC voltage is applied to a photoreceptor using a charging element, such as a brush, a roller-shaped brush, a roller, a blade or a belt, which has an appropriate electroconductivity and elasticity, while a narrow gap is formed between the charging element and the photoreceptor. These short range charging methods are practically used recently.

When an organic photoreceptor is used, it is effective to use the contact charging methods or short range charging methods because of having the following advantages:

(1) having high charge efficiency;

(2) generation of corona-discharge-induced products such as ozone and NOx can be reduced, resulting in prevention of occurrence of undesired images such as blurring and tailing, thereby prolonging the life of the photoreceptor.

With respect to the contact charging methods or short range charging methods, various methods have been disclosed in, for example, Japanese Laid-Open Patent Publications Nos. 56-104351, 57-178267, 58-40566 and 58-150975.

However, generation of the corona-discharge-induced products cannot be perfectly avoided even when these methods are used. Therefore, high durability and stability cannot be imparted to an organic photoreceptor only by using these methods.

In addition, in attempting to impart resistance to the chemical and electrical stresses to an organic photoreceptor, techniques in which an additive is added to the photosensitive layer of the photoreceptor. For example, Japanese Laid-Open Patent Publications Nos. 6-83097, 7-152217 and 7-84394 have disclosed techniques in which a fluorine-containing resin is included in a top layer such as a photosensitive layer or a protective layer to control the surface energy of the layer, resulting in improvement of the chemical durability of the photoreceptor. However, desired durability cannot be imparted to the photoreceptor even when the addition quantity of such an additive is changed. In addition, there is a possibility that such an additive adversely affects the properties of the photoreceptor such as electric property and the like.

Because of these reasons, a need exists for an electrophotographic photoreceptor which can produce images having good image qualities and which has high durability and stability.

SUMMARY OF THE INVENTION

Accordingly, an object of the present invention is to provide an electrophotographic photoreceptor which can produce images having good image qualities and which has high durability and stability.

Another object of the present invention is to provide an image forming apparatus which can stably produce images having good image qualities without frequently changing its photoreceptor.

Briefly these objects and other objects of the present invention as hereinafter will become more readily apparent can be attained by a photoreceptor which includes a photosensitive layer on which nitrate ion ($NO_3^-$) is present in an amount of from 50 to 300 μg per 1 $m^2$ of the surface thereof, when measured by an ion chromatography method. Namely, nitrate ion detected from the surface of the photoreceptor is in the above-mentioned range. The surface layer of the photoreceptor may be the photosensitive layer, a protective layer or the like layer. When a protective layer is formed as the surface layer, the layer preferably includes a filler and/or a charge transport material.

In addition, it is preferable that a material including a fluorine atom and a carbon atom is present on the surface and when the surface of the photoreceptor is analyzed by an X-ray photoelectron spectroscopy (XPS) method, the ratio or the number of fluorine atoms to the umber of carbon atoms (F/C) is preferably from 0.05 to 0.5. Preferably a material including a fluorine-containing resin such as polytetrafluoroethylene is present on the surface such that there is an interface between the material and the surface of the photoreceptor.

Alternatively, a fatty acid metal salt such as zinc stearate is present on the surface of the photoreceptor such that there is an interface between the material and the surface of the photoreceptor. In this case, it is preferable that the surface is analyzed by an XPS method, the ratio of the number of metal (zinc) atoms to the number of carbon atoms (M(Zn)/C) is from 0.001 to 0.1.

In another aspect of the present invention, an image forming apparatus including a photoreceptor, a charger which charges the surface of the photoreceptor, a light irradiator which irradiates the photoreceptor with imagewise light to form an electrostatic latent image thereon, an image developer which develops the electrostatic latent image with a developer including a toner to form a toner image, a transfer which transfer the toner image to a receiving material and a fixer which fixes the toner image on the receiving material, wherein the photoreceptor is the photoreceptor of the present invention. The image forming apparatus may further include a lubricant applicator which applies a lubricant such as materials including a fluorine atom and a carbon atom and fatty acid metal salts.

In yet another aspect of the present invention, a process cartridge which at least includes a housing and the photoreceptor of the present invention which is contained in the housing is provided.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
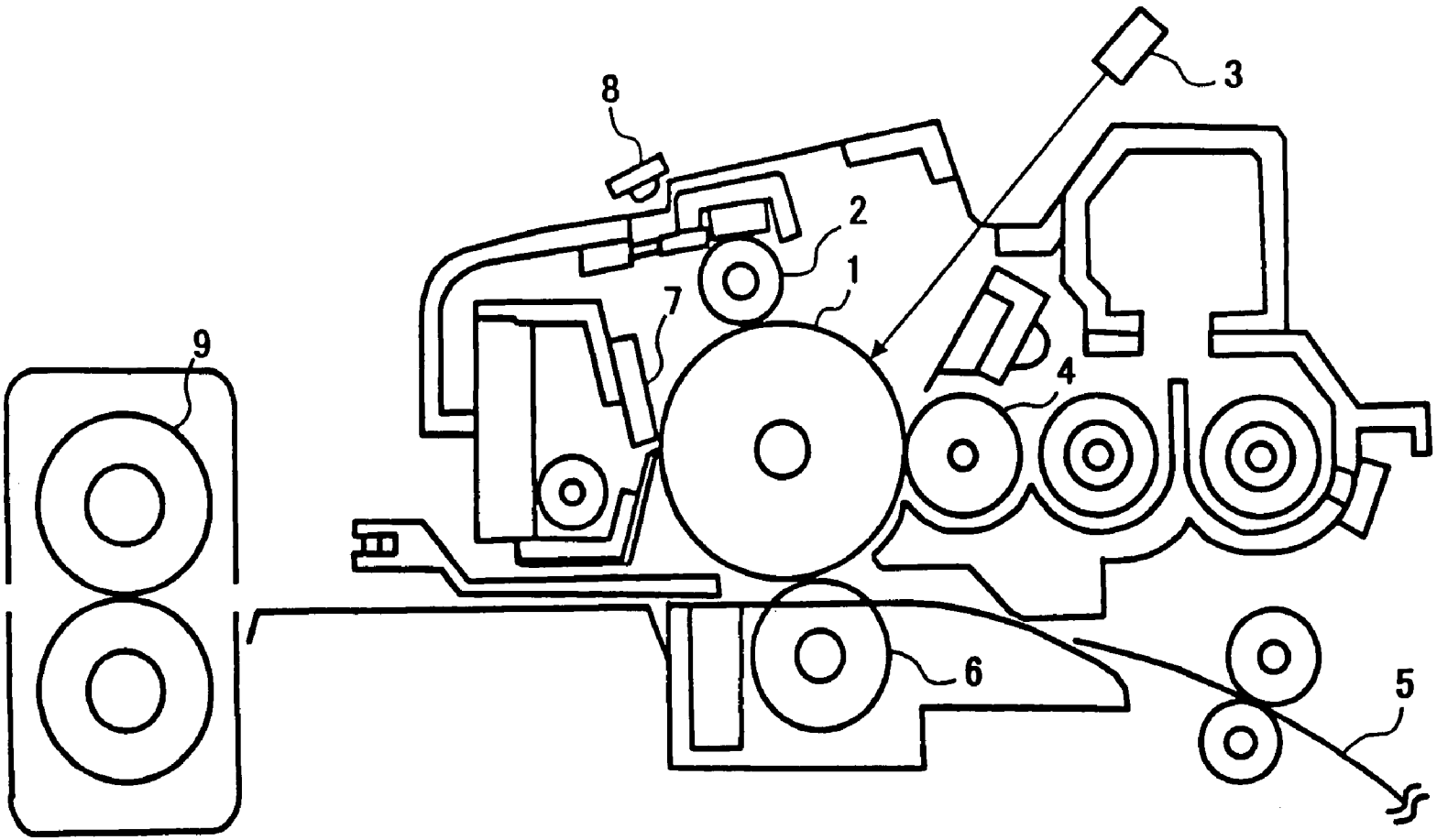
FIG. 1 is a schematic view illustrating a main part of an embodiment of the image forming apparatus of the present invention.

Generally, the present invention provides a photoreceptor which includes a photosensitive layer on which nitrate ion ($NO_3^-$) is present in an amount of from 50 to 300 μg per $m^2$of the surface, when measured by an ion chromatography method. The photoreceptor having such a property can stably produce images having high resolution.

In addition, it is preferably that a material having a fluorine atom and a carbon atom is present on the surface of the photoreceptor and when the surface of the photoreceptor is analyzed by an XPS method, the ratio of the number of fluorine atom to the number of carbon atom (F/C) is from 0.05 to 0.5. Alternatively, a fatty acid metal salt such as zinc stearate may be present on the surface and when the surface is analyzed by an XPS method, the ratio of the number of metal (zinc) atom to the number of carbon atom (M(Zn)/C) is from 0.001 to 0.1.

The photoreceptor having a combination of the former property and at least one of the latter properties can stably produce images having high resolution and has good durability.

The present invention also provides an image forming apparatus using the photoreceptor of the present invention. The thus prepared photoreceptor or image forming apparatus has good durability and can stably produce images having high resolution.

When the photosensitive layer of a photoreceptor is abraded, the electric properties of the photoreceptor, such as surface potential and photo-decay properties, change. Therefore, images (i.e., the final output) having good image qualities cannot be produced by the predetermined processes.

The photoreceptor is abraded by contacting other units such as a cleaning unit, a developing unit and a transferring unit. Among these units, the cleaning unit, which mechanically removes the residual toner particles on the photoreceptor using a blade or a brush, has a great influence on the abrasion of the photoreceptor.

The abrasion of a photoreceptor in the cleaning unit is classified into the following two types of abrasion:

(1) abrasion due to the shear strength applied to the photoreceptor by a blade or a brush (first type abrasion); and (2) abrasion due to toner particles which are present between the photoreceptor and a blade or a brush and which serves like a whetstone or sandpaper (second type abrasion).

As the factors having an influence on the abrasion are as follows:

(1) mechanical strength of the photoreceptor;

(2) contact pressure of the cleaning blade or brush;

(3) hardness of the toner particles; and (4) coefficient of friction (μ) of the surface of the photoreceptor.

The present inventors discover that there is a correlation between the first type abrasion of a photoreceptor and the shear strength applied to the photoreceptor by a blade (or a brush) Therefore it is discovered that by controlling the coefficient of friction of the surface of a photoreceptor so as to be low, the abrasion of the photoreceptor can be reduced, namely, high durability can be imparted to the photoreceptor and image forming apparatus.

In order to decrease the coefficient of friction of the surface of a photoreceptor, for example, the following methods can be used:

(1) a material which decreases coefficient of friction is added or dispersed in the surface layer of the photoreceptor; and (2) a lubricant is applied to the surface of the photoreceptor from the outside.

The former method has an advantage over the latter method in that a lubricant applying device is not needed in the image forming apparatus. However, the former method has drawbacks such that the lubricating effect cannot be maintained for a long time, and when the material is added too much, the material adversely affects the characteristics of the photoreceptor.

On the contrary, the latter method has advantages such that the lubricating effect can be maintained for a long time, and the lubricant hardly affect adversely the characteristics of the photoreceptor because the lubricant is present only on the surface of the photoreceptor.

Next, the method for preventing a photoreceptor from being deteriorated by corona-discharge-induced ionic products in the charging process and image transfer process will be explained in detail.

When such corona-discharge-induced ionic products adhere on the surface of a photoreceptor, the surface resistance and bulk resistance of the photoreceptor decrease, resulting in deterioration of the photosensitive layer. The reason is considered to be that the ionic products adhere to or react with the materials in the photosensitive layer. In particular, under high humidity conditions, water is adsorbed on the surface of the photoreceptor, and the resistance of the photoreceptor in the surface direction decreases because the ionic products are present on the surface thereof. Therefore, the surface potential of an electrostatic latent image formed on the surface of the photoreceptor decreases, and thereby images having good image qualities cannot be formed. Therefore, it is necessary to control the amount of the corona-discharge-induced ionic products present on the surface of the photoreceptor so as to fall in a certain range.

The corona-discharge-induced ionic products include various ionic materials such as ammonium nitrate. Among these ionic materials, a nitrate ion ($NO_3^-$), is generated in a greater amount than the other materials. Therefore, the amount of the ionic products present on the surface of a photoreceptor can be monitored by measuring the amount of a nitrate ion.

In order to control the amount of the corona-discharge-induced ionic products present on the surface of a photoreceptor so as to fall in the range mentioned above, the following methods can be used:

(1) the voltage applied to the charging element is controlled so as to be as small as possible;

(2) the voltage is timely applied to the photoreceptor to minimize the time for charging the photoreceptor;

(3) the ionic products adhered on the photoreceptor are removed by a cleaning blade which has an appropriate hardness and to which an appropriate pressure is applied;

(4) the ionic products adhered on the photoreceptor are removed by a cleaning brush having fibers, which are made of polyester, nylon or the like optionally subjected to an electroconductive treatment and which have an appropriate hardness, diameter, and density, wherein the pressure, rotation speed and rotation direction of the brush are optimized;

(5) ionic products are removed from the photoreceptor by being rubbed by a rotating cleaning unit without performing image forming processes such as a charging process and a developing process (i.e., only an ion product removing process is performed without performing image forming processes); and the like method.

It is important to control the amount of the nitrate ion present on the surface of a photoreceptor, rather than which method is used.

The image forming apparatus of the present invention will be explained in detail referring to drawings.

FIG. 1 is a schematic view illustrating a main part of the image forming apparatus of the present invention.

In FIG. 1, numeral 1 denotes a photoreceptor having a drum shape, which rotates in a direction as indicated by an arrow. Around the photoreceptor 1, a contact charger (or a short range charger) 2 which charges the photoreceptor 1; a light irradiator 3 which irradiates the charged photoreceptor 1 with imagewise light to form an electrostatic latent image on the photoreceptor 1; an image developer 4 which develops the electrostatic latent image with a developer including a toner to form a toner image on the photoreceptor 1; a contact transfer 6 which transfers the toner image to a receiving material 5; a cleaner 7 which removes the residual toner particles on the surface of the photoreceptor 1; a discharging lamp 8 which discharges the residual potential on the photoreceptor 1; and a fixer 9 which fixes the toner image on the receiving material 5, are provided.

Figure 10:
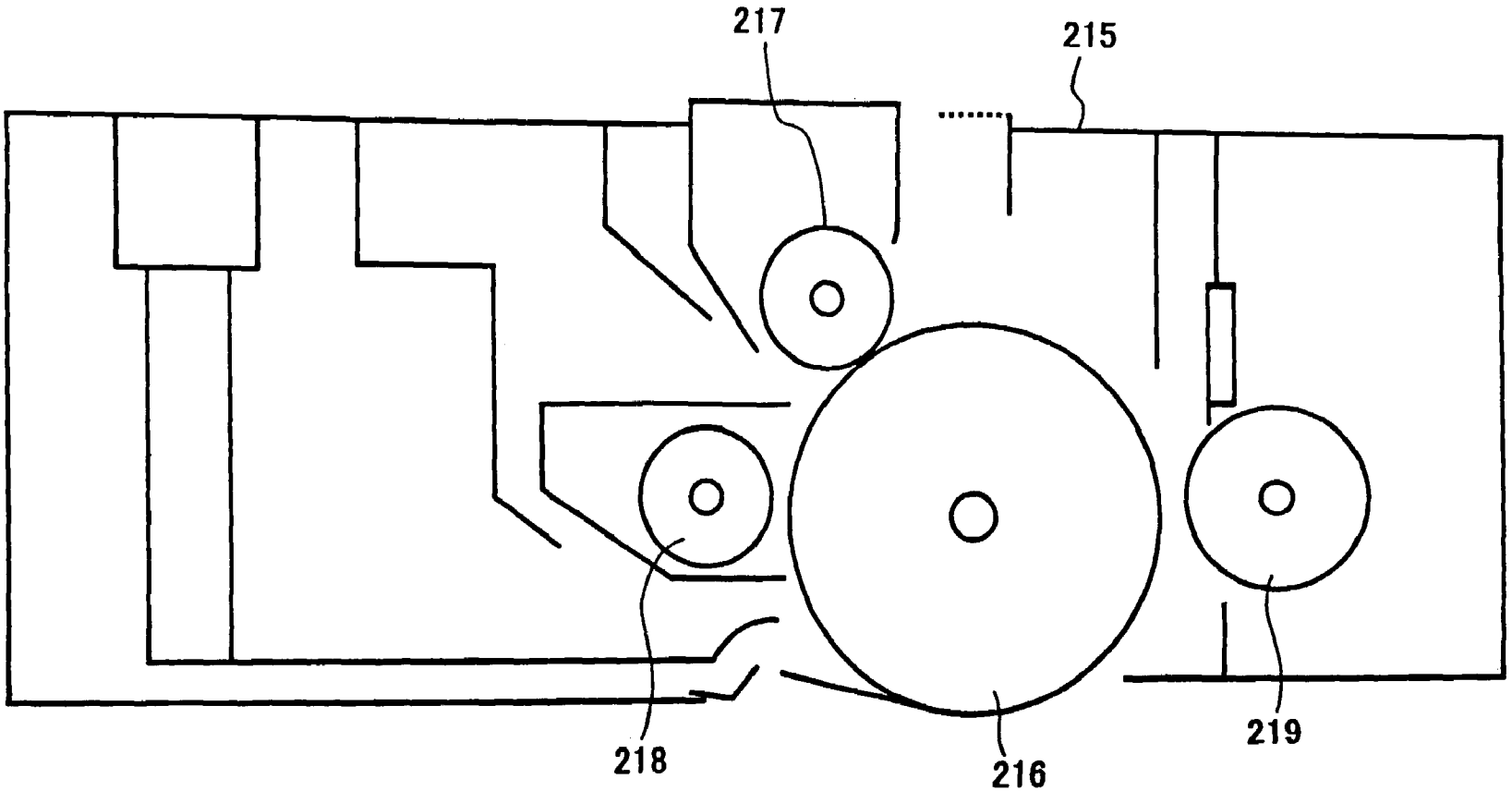
FIG. 10 is a schematic view illustrating an embodiment of the process cartridge of the present invention.

FIG. 10 is a schematic view illustrating an embodiment of the process cartridge of the present invention. The process cartridge is used for image forming apparatus while being detachably attached to the apparatus.

In FIG. 10, the process cartridge includes a housing 215, a photoreceptor 216, a charger 217, a cleaning brush 218, and a developing roller 219. The photoreceptor 216 is the photoreceptor of the present invention. The constitution of the process cartridge of the present invention is not limited thereto. The process cartridge of the present invention includes at least the housing 215 and the photoreceptor of the present invention.

FIGS. 2 to 5 are schematic views illustrating embodiments of the lubricant applicator for use in the image forming apparatus of the present invention.

Figure 2B:
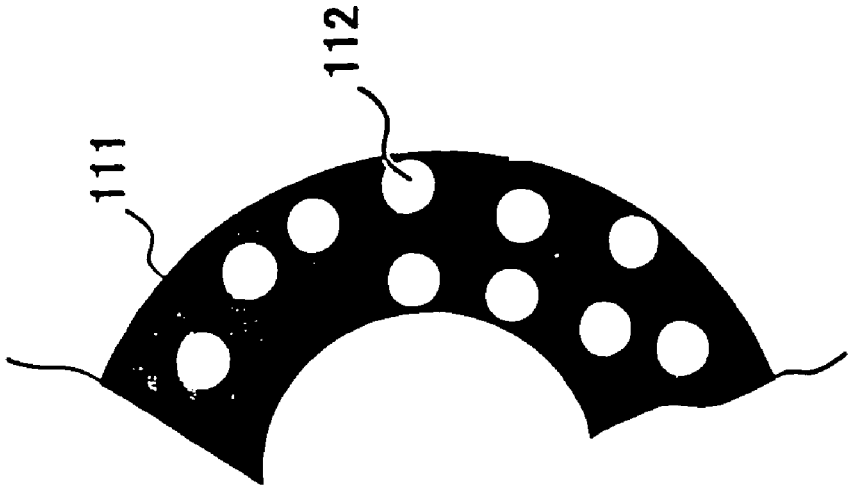
FIGS. 2A and 2B are schematic views illustrating an embodiment of the lubricant applicator for use in the image forming apparatus of the present invention.
Figure 2A:
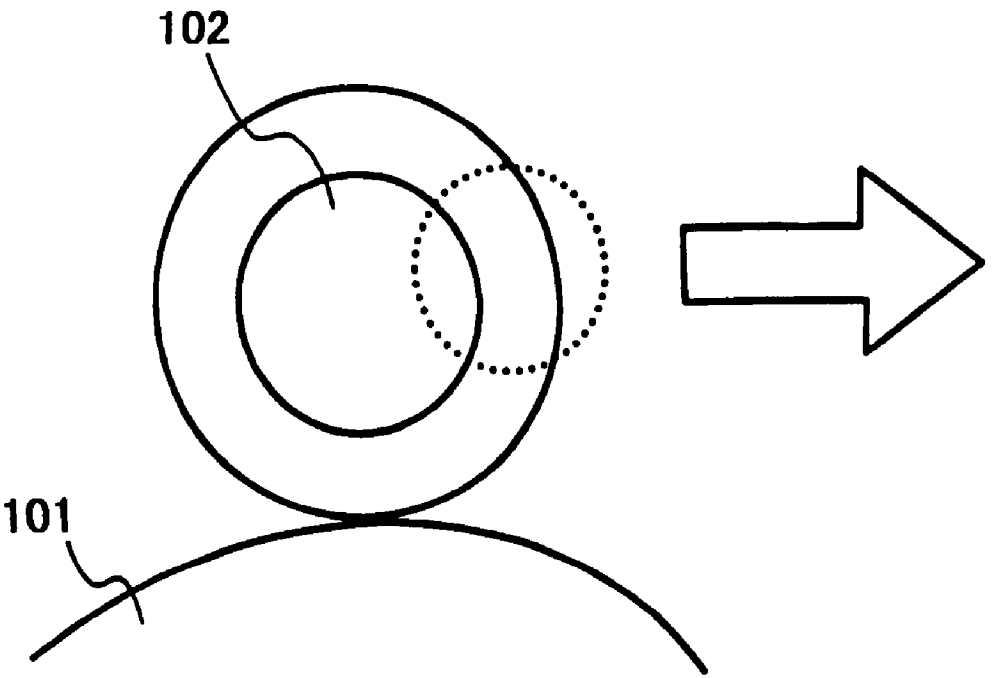

In FIG. 2A, a lubricant is applied to the photoreceptor in the charging process. Numerals 101 and 102 denote a photoreceptor and a contact charging roller, respectively. A part of the contact charging roller 102 is enlarged in FIG. 2B. In FIG. 2B, numerals 111 and 112 denote a charging material for charging the photoreceptor 101, and a lubrication applying material for applying lubrication to the surface of the photoreceptor 101, respectively. The contact charging roller 102 applies the lubrication applying material on the surface of the photoreceptor 101.

Figure 3A:
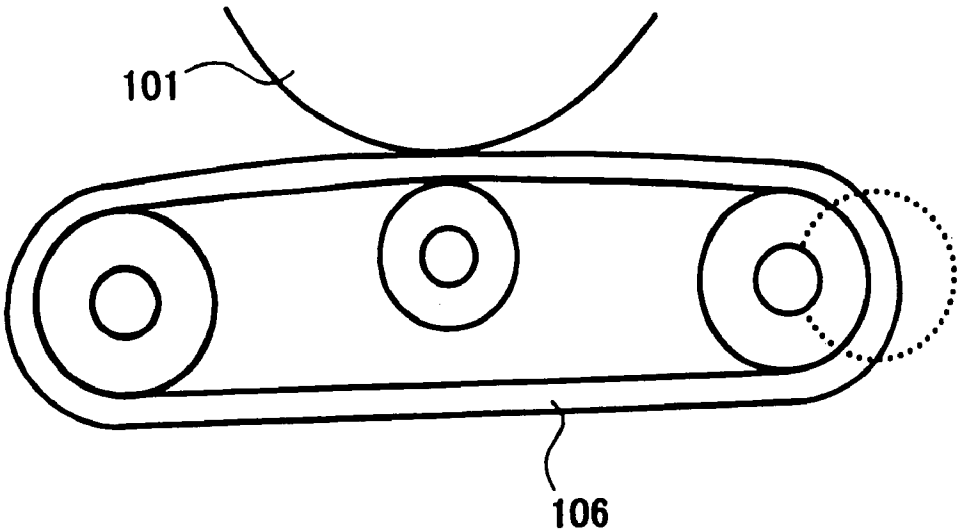
FIGS. 3A and 3B are schematic views illustrating another embodiment of the lubricant applicator for use in the image forming apparatus of the present invention.
Figure 3B:
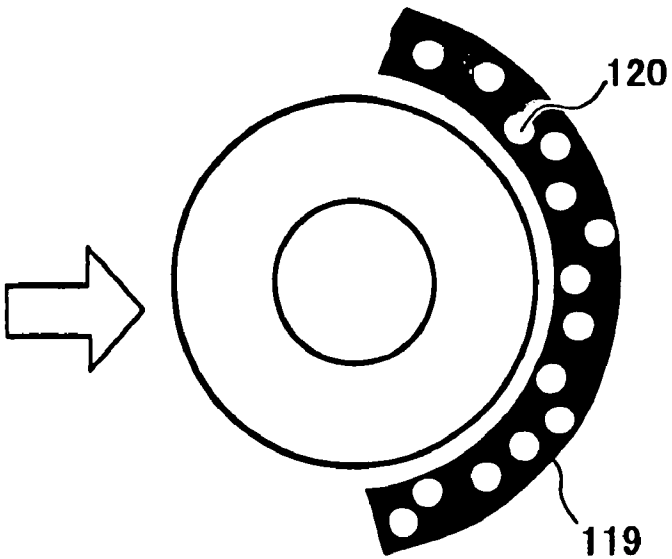

In FIG. 3A, a lubricant is applied to the photoreceptor in the transfer process. Numeral 106 denotes a transfer belt. A part of the transfer belt 106 is enlarged in FIG. 3B. In FIG. 3B, numerals 119 and 120 denote a transfer voltage applying material and a lubrication applying material for applying lubrication to the surface of the photoreceptor 101, respectively. The transfer belt 106 applies the lubrication applying material to the surface of the photoreceptor 101.

Figure 4:
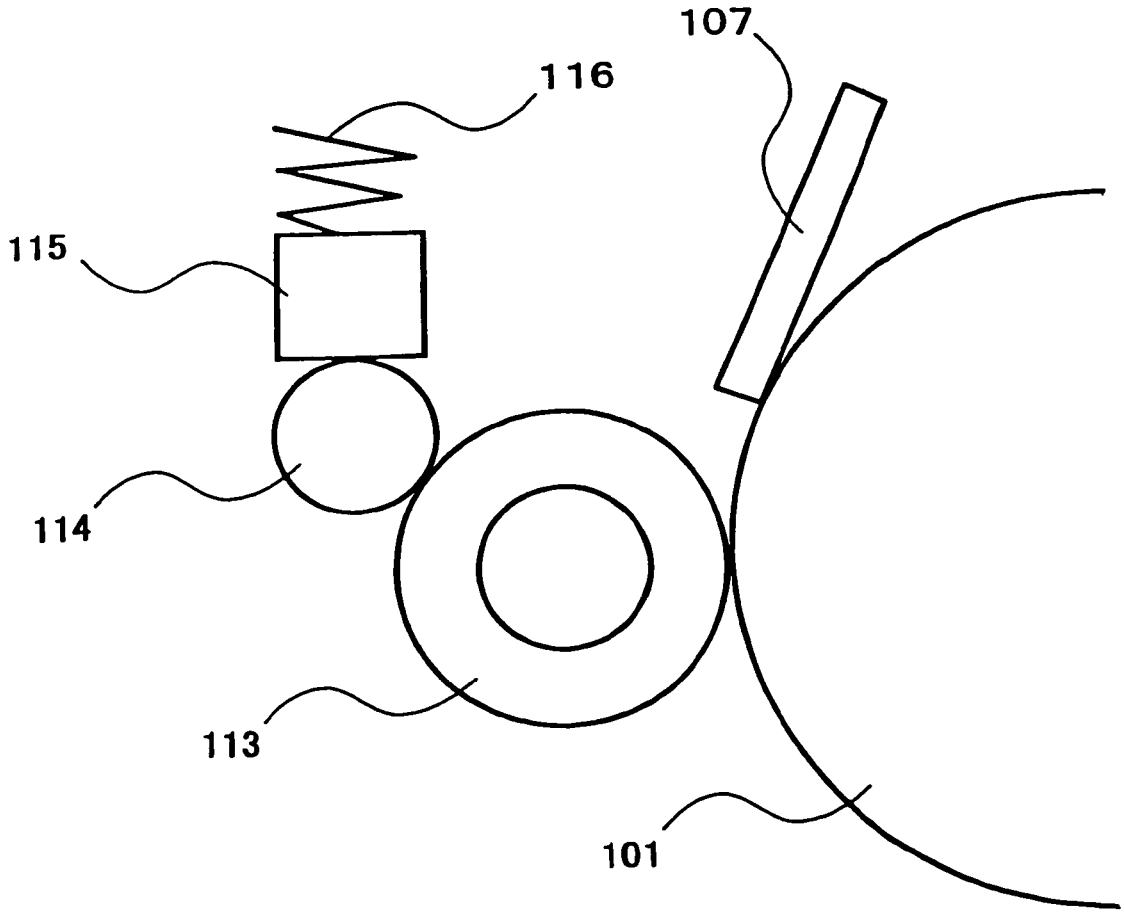
FIG. 4 is a schematic view illustrating yet another embodiment of the lubricant applicator for use in the image forming apparatus of the present invention.

In FIG. 4, a lubricant applying device is provided before the cleaning unit. Numerals 107 and 113 denote a cleaning blade, and a cleaning brush, respectively. A lubricant applying roller 114 applies a lubricant 115 to the cleaning brush 113. The lubricant 115 is therefore applied to the surface of the photoreceptor 101. The lubricant 115 is pressed by a spring 116.

Figure 5:
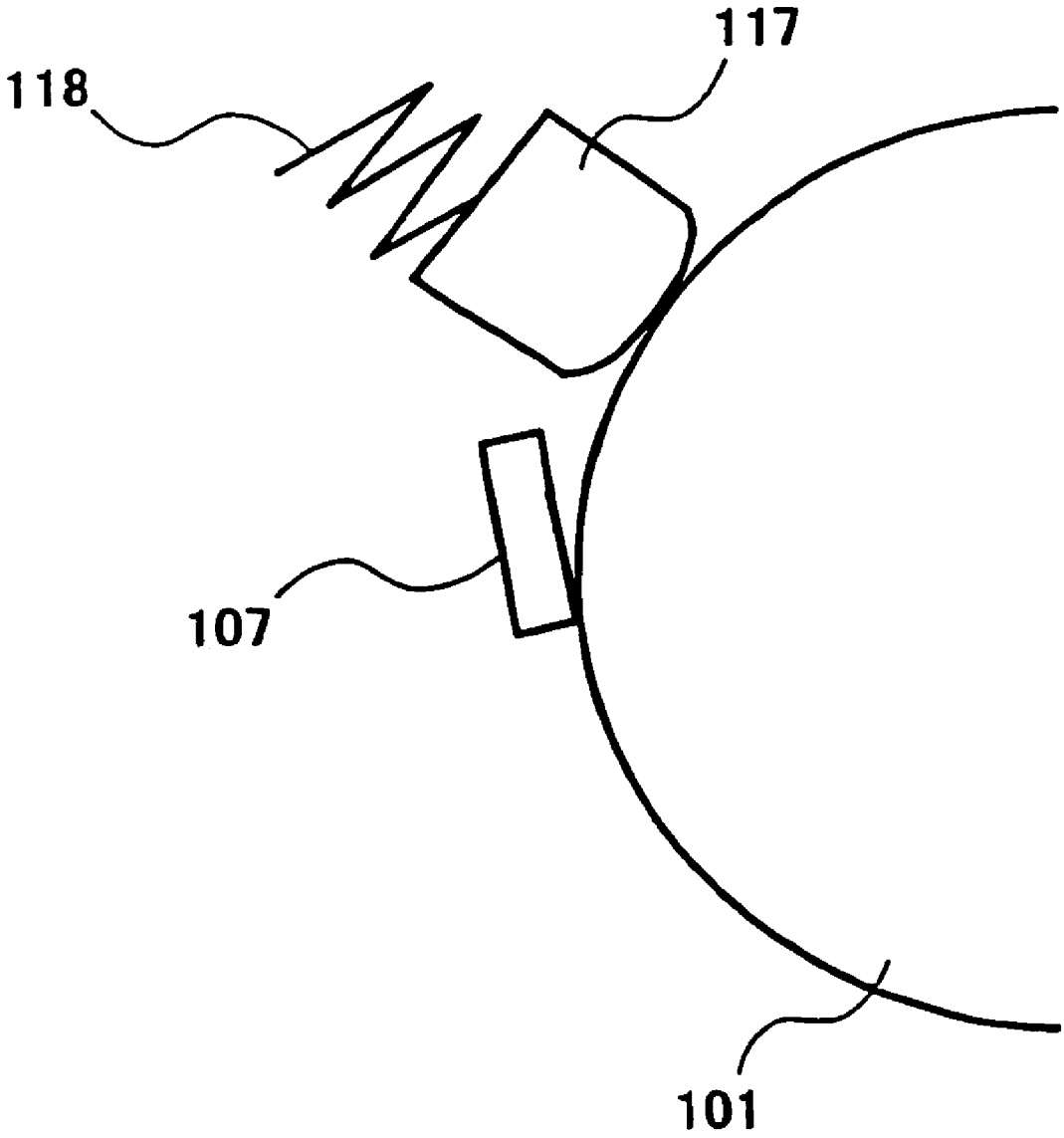
FIG. 5 is a schematic view illustrating a further embodiment of the lubricant applicator for use in the image forming apparatus of the present invention.

In FIG. 5, a lubricant applying device is provided after the cleaning unit. A lubricant applying element 117 applies a lubricant to the surface of the photoreceptor 101 while being pressed by a spring 118.

In addition, a lubricant can also be applied to the photoreceptor by using a toner including the lubricant such as fatty acid metal salts (e.g., zinc stearate) or a developer including the lubricant for the image forming apparatus as shown in FIG. 1. In this case, it is preferable that a replenishing toner including the lubricant or a replenishing developer including the developer, which is contained in a container (not shown) is supplied to the developing unit little by little.

The method for applying a lubricant to the surface of the photoreceptor is not limited to the above-mentioned methods, and any method in which a lubricant is applied to the surface of the photoreceptor from the outside can be employed.

Next, the image forming processes will be explained in detail.

At first, the charging process will be explained. As mentioned above, the charging methods are classified into two types, one of which is non-contact charging methods and the other of which is contact charging methods.

Among the non-contact charging methods, a corona discharging method is well known which charges a photoreceptor using an electroconductive element such as wires and plates, which is provided apart from the surface of the photoreceptor and to which a high voltage is applied. This method has an advantage in that the surface of a photoreceptor can be uniformly charged, and therefore the method has been typically used.

On the contrary, in the contact charging methods, a photoreceptor is charged by a charging element, such as brushes, roller-shaped brushes, rollers, blades and belts, which has an appropriate electroconductivity and elasticity and which contacts the surface of the photoreceptor. These contact charging methods have been disclosed in Japanese Laid-Open patent Publications Nos. 63-149668 and 7-281503.

The contact charging methods have an advantage over the non-contact charging methods in that the voltage applied to the photoreceptor can be reduced and thereby the amount of generated ozone, which is considered to damage human beings and photoreceptors, can be reduced. Therefore, these contact charging methods have widely spread.

As intermediate methods between the contact charging methods and non-contact charging methods, short range charging methods in which a DC voltage overlapped with a DC or AC voltage is applied to a photoreceptor using a charging element, such as a brush, a roller-shaped brush, a roller, a blade or a belt, which has an appropriate electroconductivity and elasticity, while a narrow gap is formed between the charging element and the photoreceptor. The short range charging methods are practically used recently.

The charging process is followed by a light irradiating process. The light irradiating device irradiates the charged photoreceptor with imagewise light. The imagewise light may be an analogue light image which is the light image reflected from an original document and passing through a lens or a mirror, or a digital light image which is emitted by a laser diode and a light emitting device and which is obtained by reproducing electric signals output from a computer or signals which are obtained by reading a document by a sensor such as charge coupled devices (CCDs). Recently, the light irradiating device irradiating a digital light image is typically used because various image processing is possible and images having good image qualities can be stably produced.

An electrostatic latent image formed on the photoreceptor is then developed with a developing device, which contains a developer including a toner, to form a toner image on the photoreceptor. As the developer, one component dry developers, two component dry developers and liquid developers can be used.

The toner image formed on the photoreceptor is directly transferred onto a receiving material such as paper, plastic films and the like. The toner image on the photoreceptor is optionally transferred onto an intermediate transfer material, and then transferred onto a receiving material. In order to transfer the toner image, one or more of the above-mentioned non-contact charging methods using corona discharging and contact charging methods using a roller, a brush or a belt are typically used.

After transferring the toner image, the residual toner on the photoreceptor is removed by a cleaning unit. The cleaning unit typically includes a roller-shaped brush or an elastic blade by which the residual toner is squeezed. In recent years, there are image forming apparatus which do not have a cleaning unit because toner images are transferred on a receiving material with high efficiency.

The lubricant applicator, which applies a lubricant to the surface of the photoreceptor, is classified into devices as shown in FIG. 5 which directly apply a lubricant to the surface of the photoreceptor and devices as shown in FIG. 4 which indirectly apply a lubricant to the surface of the photoreceptor.

Specific examples of such a lubricant includes lubricating liquids such as silicone oils and fluorine-containing oils; fluorine-containing resins such as polytetrafluoroethylene (PTFE), perfluoroalkylvinyl ether (PFA) and polyvinylidene fluoride (PVDF); lubricating solids (e.g., powder) such as silicone resins, polyolefin resins, silicone grease, fluorine-containing grease, paraffin waxes, fatty acid esters, fatty acid metal salts such as zinc stearate, graphite and molybdenum disulfide; and the like.

Among these materials, fluorine-containing resins and fatty acid metal salts are preferable because of being easy to handle and having good lubricating properties. Among the fluorine-containing resins, PTFE is preferable because of being easily processed into any desired shape and decreasing the friction coefficient of,the surface of the photoreceptor.

Among the fatty acid metal salts, metal salts of palmitic acid, stearic acid and oleic acid are preferable. As the metal of the fatty acid metal salts, zinc, calcium and aluminum are preferable. In particular, zinc stearate and zinc palmitate are preferable.

Next, it will be explained why the content of nitrate ion detected from the surface of the photoreceptor and/or the fluorine/carbon ratio or the zinc/carbon ratio at the surface of the photoreceptor should be controlled.

As mentioned above, when ionic products generated in various charging operations adhere on the surface of a photoreceptor, the surface tends to adsorb water, resulting in decrease of the surface resistance of the photoreceptor.

On the other hand, in recent years, image forming apparatus having a digital light image irradiating device using a laser diode or an LED array are widely used. In these image forming apparatus, the diameter of the light beam used for the digital light image irradiating device becomes smaller and smaller to produce images having high resolution. The diameter of the light beam is about 50 μm or less now because the optics used therefor are improved.

A fine electrostatic latent image which is formed using such a light beam having small diameter is sensitive to the change of the surface resistance of the photoreceptor. Therefore, good electrostatic latent images cannot be stably formed on the surface of such a photoreceptor whose surface resistance easily changes depending on the environmental conditions such as humidity, even though good electrostatic latent images can be formed thereon by the conventional light image irradiating device such as analogue light image irradiating devices.

In order to form good electrostatic latent images on a photoreceptor using a digital light image irradiating device, the amount of nitrate ion present on the surface of the photoreceptor is preferably from about 50 to about 300 μg per 1 $m^2$ of the surface of the photoreceptor. The method for measuring the amount of nitrate ion present on the surface of a photoreceptor is explained later.

When the nitrate ion concentration on the surface of a photoreceptor is too high, good electrostatic latent images cannot be formed on the photoreceptor especially under high humidity conditions. On the contrary, when the nitrate ion concentration is too low, the surface potential on the photoreceptor has significant dependence on environmental conditions when using a contact charging method.

As mentioned above, when the friction coefficient of the surface of a photoreceptor is decreased, the abrasion of the surface of the photoreceptor can be reduced. In addition, it is preferable that a lubricant is applied to the surface of a photoreceptor from the outside because of hardly producing adverse effect and maintaining the effect for the long time. In this case, the friction coefficient of the surface of the photoreceptor depends on the amount of the lubricant present on the surface thereof. In addition, it is important that the lubricant is not a constituent of the photoreceptor, i.e., a clear interface is present between the surface of the photoreceptor and the lubricant layer formed on the surface.

As mentioned above, various lubricants can be used in the present invention. However, among the lubricants, fluorine-containing materials and fatty acid metal salts are preferable because of being easy to handle and having good lubrication imparting property, and chemical stability.

When the friction coefficient of the surface of a photoreceptor is too large, the surface of the photoreceptor is easily abraded, resulting in shortage of the life of the photoreceptor. On the contrary, when the friction coefficient is too low, the adhesion of toner particles to the photoreceptor decreases, and thereby the problem which occurs is that a desired toner image cannot be formed on the photoreceptor. This problem is particularly occurs when an electrostatic latent image on a photoreceptor is developed with a two component developer while the developer contacts the surface of the photoreceptor. This is because the toner image once formed on the photoreceptor is scraped or moved by the ears of the developer.

This problem is fatal to the image forming apparatus because images having high resolution cannot be produced. In order to avoid this problem, the friction coefficient of the photoreceptor is controlled. As a result of the present inventors' investigation using a fluorine-containing material, preferably a material having a fluorine-carbon bond, as a lubricant which is applied to the surface of a photoreceptor from the outside, it is discovered that the ratio of fluorine/carbon (F/C) on the surface of the photoreceptor, when the surface is analyzed by an XPS method, is preferably from 0.05 to 0.5 by atom. In this case, the carbon atoms present in the surface layer of the photoreceptor is detected by the XPS method, when the lubricant layer is relatively thin. However, it is discovered that there is a relationship between the F/C ratio and resolution of the recorded images. Namely, when the F/C ratio is too large, blurred images tend to be produced. When the ratio is too small, the abrasion problem tend to occur.

In addition, as a result of the present inventors' investigation using various fatty acid zinc salts as the lubricant, it is discovered that the ratio of zinc/carbon (Zn/C) on the surface of the photoreceptor, when the surface is analyzed by an XPS method, is preferably from 0.001 to 0.1 by atom. In this case, when the ratio is out of the range, the problems mentioned above tend to also occur.

As can be understood from the above-description, the nitrate ion concentration is preferably controlled so as to fall in the range of from 50 to 300 μg/$m^2$ while controlling the F/C ratio so as to fall in the range of from 0.05 to 0.5 by atom or controlling the Zn/C ratio so as to fall in the range of from 0.01 to 0.1 by atom, to prolong the life of the photoreceptor and to form toner images having good resolution even when a light beam having small diameter is used. This is achieved by applying a lubricant such as fluorine-containing materials or fatty acid zinc salts on the surface of the photoreceptor while the nitrate ion concentration is controlled by the methods mentioned above.

Then the photoreceptor for use in the present invention will be explained in detail.

As the photosensitive layer for use in the photoreceptor of the present invention, for example, the following known photosensitive layers can be used:

(1) a photosensitive layer, which is mainly constituted of selenium or a selenium alloy;
(2) a photosensitive layer, which is mainly constituted of a binder resin and an inorganic photoconductor such as zinc oxide and cadmium sulfide;
(3) a photosensitive layer, which is mainly constituted of amorphous silicon; and
(4) a photosensitive layer, which is mainly constituted of one or more organic photosensitive materials.

Figure 6:
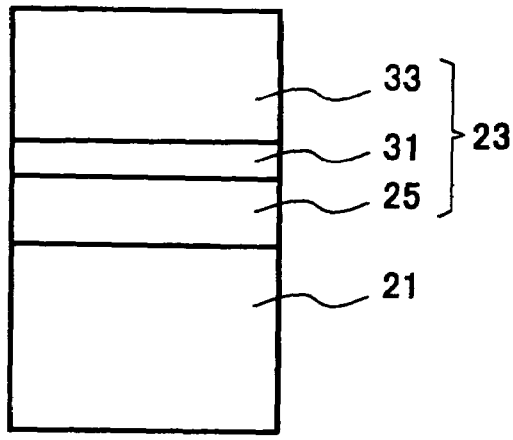
FIG. 6 is a cross section of an embodiment of the photoreceptor of the present invention.
Figure 7:
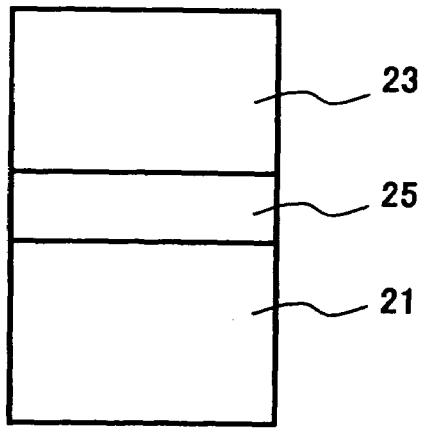
FIG. 7 is a cross section of another embodiment of the photoreceptor of the present invention.
Figure 8:
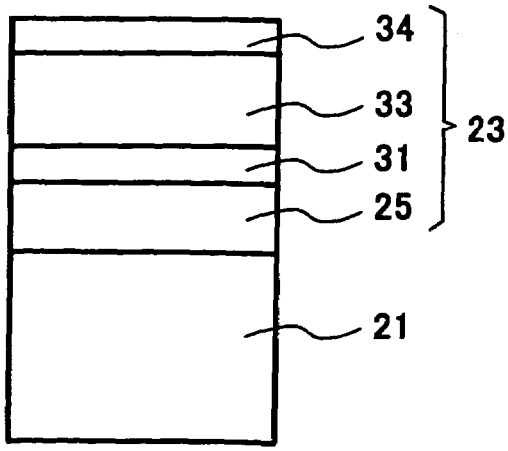
FIG. 8 is a cross section of yet another embodiment of the photoreceptor of the present invention.

FIGS. 6 to 8 are cross sections of embodiments of the organic photoreceptor for use in the present invention. In FIG. 6, an undercoat layer 25, a charge generation layer 31 and a charge transport layer 33 are formed on an electroconductive substrate 21 in this order. In FIG. 7, an undercoat layer 25 and a photosensitive layer 23 are formed on an electroconductive substrate 21 in this order. In FIG. 8, an undercoat layer 25, a charge generation layer 31, a charge transport layer 33 and a protective layer 34 are formed on an electroconductive substrate 21 in this order. The structure of the organic photoreceptor for use in the present invention is not limited thereto. In the present invention, as shown in FIGS. 6 and 8, the undercoat layer 25 and the protective layer 34 is considered as a layer of the photosensitive layer 23.

Suitable materials for use as the electroconductive substrate 21 include materials having a volume resistance not greater than $10^{10}$ Ωcm. Specific examples of such materials include plastic cylinders, plastic films or paper sheets, on the surface of which a metal such as aluminum, nickel, chromium, nichrome, copper, silver, gold, platinum, iron and the like, or a metal oxide such as tin oxides, indium oxides and the like, is deposited or sputtered. In addition, a tube can also be used as the substrate 21 which is prepared by tubing a plate of a metal such as aluminum, aluminum alloys, nickel, stainless steel and the like, or tubing by a method such as impact ironing or direct ironing, and then subjecting the surface of the tube by a cutting, super finishing, polishing and/or the like treatment. Further, endless belts of a metal such as nickel, stainless steel and the like can also be used as the substrate 21.

The photosensitive layer of the photoreceptor for use in the present invention may be a single layer type or a multi-layer type. At first the multi-layer type organic photosensitive layer will be explained referring to the photoreceptor as shown in FIG. 6 for only explanation convenience.

The charge generation layer 31 is mainly constituted of a charge generation material, and optionally a binder resin is used. As the charge generation material, inorganic or organic charge generation materials can be used.

Specific examples of the inorganic charge generation materials include crystalline selenium, amorphous selenium, selenium-tellurium alloys, selenium-tellurium-halogen alloys, selenium-arsenic alloys and amorphous silicon. Suitable amorphous silicon includes ones in which a dangling bond is terminated with a hydrogen atom or a halogen atom, or in which a boron atom or a phosphorus atom is doped.

Specific examples of the organic charge generation materials include phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole and the like materials.

These charge transport materials can be used alone or in combination.

Specific examples of the binder resin, which is optionally used in the charge generation layer 31, include polyamide resins, poly urethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like. These binder resins can be used alone or in combination. In addition, one or more charge transport materials may be included in the charge generation layer 31.

Charge transport materials may be added in the charge generation layer 31. Specific examples of such charge transport materials include positive hole transport materials and electron transport materials.

Specific examples of such electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthorie, 2,6,8-trinitro-4H-indeno[1,2-b]thiophene-4-one, 1,3,7-trinitrobenzothiophene-5,5-dioxide, and the like compounds. These electron transport materials can be used alone or in combination.

Specific examples of such positive hole transport materials include electron donating materials such as oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives, thiophene derivatives, and the like. These positive hole transport materials can be used alone or in combination.

Suitable methods for forming the charge generation layer 31 include thin film forming methods in a vacuum, and casting methods.

Specific examples of such thin film forming methods in a vacuum include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods useful for forming the charge generation layer 35 include, for example, the following steps:

(1) preparing a coating liquid by mixing one or more inorganic or organic charge generation materials mentioned above with a solvent such as tetrahydrofuran, cyclohexanone, dioxane, dichloroethane, butanone and the like, and if necessary, together with a binder resin and an additives, and then dispersing the materials with a ball mill, an attritor, a sand mill or the like;

(2) coating on a substrate the coating liquid, which is diluted if necessary, by a dip coating method, a spray coating method, a bead coating method, a ring coating method or the like method; and (3) drying the coated liquid to form a charge generation layer.

The thickness of the charge generation layer 31 is preferably from about 0.01 to about 5 μm, and more preferably from about 0.05 to about 2 μm.

Next, the charge transport layer 33 will be explained in detail.

The charge transport layer 33 transports the carriers which are selectively generated in the charge generation layer 31 by irradiating the photosensitive layer with imagewise light to form an electrostatic latent image on the surface of the photoreceptor. The charge transport layer may be a layer which includes one or more of the low molecular weight charge transport materials mentioned above for use in the charge generation layer 31 together with a binder resin; or a layer mainly including one or more high molecular weight charge transport materials (i.e., charge transport polymer materials). The charge transport layer 33 is typically prepared by coating a coating liquid in which the above-mentioned materials are dissolved or dispersed in a solvent, and then drying the coated liquid.

Specific examples of the binder resins which are used in combination with the low molecular weight charge transport materials include polycarbonate resins such as bisphenol A type and bisphenol Z type polycarbonate resins, polyester resins, methacrylic resins, acrylic resins, polyethylene resins, vinyl chloride resins, vinyl acetate resins, polystyrene resins, phenolic resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacrylamide resins, phenoxy resins, and the like resins. These binder resins can be used alone or in combination.

As the high molecular weight charge transport material, the following known charge transport polymer materials (i.e., polymers having an electron donating group) can be used:

(a) Polymers Having a Carbazole Ring in Their Main Chain and/or Side Chain

Specific examples of such materials include poly-N-vinyl carbazole, and compounds disclosed in Japanese Laid-Open Patent Publications Nos. 50-82056, 54-9632, 54-11737, and 4-183719.

(b) Polymers Having a Hydrazone Skeleton in Their Main Chain and/or Side Chain

Specific examples of such materials include compounds disclosed in Japanese Laid-Open Patent Publications Nos. 57-78402 and 3-50555.

(c) Polysilylene Compounds

Specific examples of such materials include polysilylene compounds disclosed in Japanese Laid-Open Patent Publications Nos. 63-285552, 5-19497 and 5-70595.

(d) Polymers Having a Tertiary Amine Skeleton in Their Main Chain and/or Side Chain Specific examples of such materials include N,N-bis(4-methylphenyl)-4-aminopolystyrene, and compounds disclosed in Japanese Laid-Open Patent Publications Nos. 1-13061, 1-19049, 1-1728, 1-105260, 2-167335,5-66598 and 5-40350.

(e) Other Polymers

Specific examples of such materials include condensation products of nitropyrene with formaldehyde, and compounds disclosed in Japanese Laid-Open Patent Publications Nos. 51-73888 and 56-150749.

The high molecular weight charge transport polymer material (polymer having an electron donating group) for use in the charge transport layer 33 is not limited thereto, and known copolymers (random, block and graft copolymers) and star polymers, which have an electron donating group, and crosslinking polymers having an electron donating group disclosed in, for example, Japanese Laid-Open Patent Publication No. 3-109406 can also be used.

The high molecular weight charge transport material is optionally used together with a binder resin, a low molecular weight charge transport material and/or additives such as plasticizers and leveling agents.

Specific examples of the plasticizers include known plasticizers, which have been used for plasticizing a resin, such as dibutyl phthalate, and dioctyl phthalate. The content of the plasticizer in the charge transport layer is preferably from 0 to 30 parts by weight per 100 parts by weight of the binder resin (and/or charge transport polymer material) included in the layer.

Specific examples of the leveling agents include silicone oils such as dimethyl silicone oils and methylphenyl silicone oils; and polymers and oligomers having a perfluoroalkyl group in their side chain. The content of the leveling agent in the charge transport layer is preferably from 0 to 1 part by weight per 100 parts by weight of the binder resin (and/or charge transport polymer material) included in the layer.

The thickness of the charge transport layer 33 is preferably from 5 to 100 μm, and more preferably from 10 to 40 μm.

Then the single layer type photosensitive layer 23 will be explained referring to FIG. 7.

The photosensitive layer 23 is typically formed by coating a coating liquid including a charge generation material, and a low molecular weight charge transport material and/or a charge transport polymer material. The above-mentioned charge generation materials, low molecular weight charge transport materials and charge transport polymer materials for use in the charge generation layer 31 and charge transport layer 33 can also be used in the photosensitive layer 23.

The photosensitive layer 23 optionally includes a binder resin, and/or additives such as plasticizers and leveling agents. Specific examples of the binder resin, plasticizers and leveling agents include the materials mentioned above for use in the charge generation layer 31 and charge transport layer 33. The thickness of the photosensitive layer 23 is preferably from 5 to 100 μm, and more preferably from 10 to 40 μm.

The photoreceptor of the present invention may include the undercoat layer 25 which is formed between the electroconductive substrate 21 and the photosensitive layer 23 or the charge generation layer 31. The undercoat layer is formed, for example, to prevent moire in the resultant image, to decrease residual potential in the resultant photoreceptor, and to prevent charge injection from the substrate to the photosensitive layer, and to improve the coating quality of the upper layer (i.e., to form a uniform layer of the photosensitive layer 23 or the charge generation layer 31).

The undercoat layer 25 mainly includes a resin. Since a photosensitive layer coating liquid, which typically includes an organic solvent, is coated on the undercoat layer, the resin used in the undercoat layer preferably has good resistance to popular organic solvents.

Specific examples of such resins for use in the undercoat layer include water-soluble resins such as polyvinyl alcohol, casein and polyacrylic acid; alcohol-soluble resins such as nylon copolymers, and methoxymethylated nylons; and crosslinkable resins such as polyurethane resins, melamine resins, alkyd-melamine resins, and epoxy resins. In addition, the undercoat layer may include a fine powder such as metal oxides (e.g., titanium oxide, silica, alumina, zirconium oxide, tin oxide, and indium oxide), metal sulfides, and metal nitrides. When the undercoat layer 25 is formed using these materials, known coating methods using a proper solvent can be used similarly to the photosensitive layer.

In addition, a metal oxide layer which is formed, for example, by a sol-gel method using a silane coupling agent, titanium coupling agent or a chromium coupling agent can also be used as the undercoat layer.

Further, a layer of aluminum oxide which is formed by an anodic oxidation method, and a layer of an organic compound such as polyparaxylylene or an inorganic compound such as SiO, $SnO_2$, $TiO_2$, ITO or $CeO_2$, which is formed by a vacuum evaporation method, are also preferably used as the undercoat layer.

The photoreceptor of the present invention may include the protective layer 34 on the photosensitive layer (the photosensitive layer 23 or charge transport layer 33) to protect the photosensitive layer and to improve the durability of the photoreceptor. Specific examples of the materials for use in the protective layer 34 include ABS resins, ACS resins, olefin-vinyl monomer copolymers, chlorinated polyethers, aryl resins, phenolic resins, polyacetal resins, polyamide resins, polyamideimide resins, polyacrylate resins, polyarylsulfone resins, polybutylene resins, polybutyleneterephthalate resins, polycarbonate resins, polyethersulfone resins, polyethylene resins, polyethyleneterephthalate resins, polyimide resins, acrylic resins, polymethylpentene resins, polypropylene resins, polyphenylene oxide resins, polysulfone resins, polystyrene resins, AS resins, butadiene-styrene copolymers, polyurethane resins, polyvinyl chloride resins, polyvinylidene chloride resins, epoxy resins and the like resins.

The protective layer 34 may include a filler to improve the abrasion resistance. Specific examples of such a filler include particulate fluorine-containing resins such as polytetrafluoroethylene and silicone resins. In addition, an inorganic material such as titanium oxides, tin oxides, potassium titanate and the like can be included in the resins.

The content of the filler in the protective layer 34 is preferably from 10 to 40% by weight and more preferably from 20 to 30% by weight. When the content is. too low, abrasion resistance cannot be improved. When the content is too high, the surface potential of the photoreceptor becomes high after the photoreceptor is exposed to imagewise light, resulting in occurrence of problems such as background developing of images due to the deterioration of photosensitivity of the photoreceptor.

In order to improve the dispersion property of the filler, dispersion promoters can be used. Suitable dispersion promoters include known dispersion promoters for use in the paint. The content of the filler in the protective layer 34 is from 0.5 to 4% by weight, and preferably from 1 to 2% by weight of the filler included in the protective layer.

In addition, it is preferable to add one of the charge transport materials mentioned above to the protective layer 34 Further, the protective layer 34 may include one of the antioxidants mentioned below.

The protective layer 34 is typically formed by a coating method such as spray coating methods. The thickness of the protective layer 34 is preferably from 0.5 to 10 μm and more preferably from 4 to 6 μm.

In the present invention, an intermediate layer (not shown in figures) may be formed between the photosensitive layer 23 (or the charge transport layer 33) and the protective layer 34. The intermediate layer mainly includes a resin such as polyamide resins, alcohol-soluble nylon resins, water-soluble butyral resins, polyvinyl butyral resins, polyvinyl alcohol resins and the like resins. This intermediate layer can also be formed by any one of the known coating methods as mentioned above. The thickness of such intermediate layer is preferably from 0.05 to 2 μm.

In the photoreceptor of the present invention, one or more antioxidants can be used in one or more of the layers including an organic material, to improve the dependency of the photoreceptor on environmental conditions, i.e., to prevent deterioration of photosensitivity and increase of residual potential. In particular, good results can be obtained when an antioxidant is included in the layer including a charge transport material.

Suitable antioxidants for use in the photoreceptor include the following compounds, but are not limited thereto.

Monophenol Compounds 2,6-di-t-butyl-p-cresol, butylated hydroxyanisole, 2,6-di-t-butyl-4-ethylphenol, stearyl-β-(3,5-di-t-butyl-4-hydroxyphenyl)propionate, and the like compounds;

Bisphenol Compounds 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), and the like compounds;

High Molecular Phenolic Compounds 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like compounds.

Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like compounds.

Hydroquinone Compounds 2, 5-di-t-octylhydroquinone, 2,6-didodecylhydroquinone, 2-dodecylhydroquinone, 2-dodecyl-5-chlorohydroquinone, 2-t-octyl-5-methylhydroquinone, 2,-(2-octadecenyl)-5-methylhydroquinone, and the like compounds.

Sulfur-containing Organic Compounds dilauryl-3,3'-thiodipropionate, distearyl-3,3'-thiodipropionate, ditetradecyl-3,3'-thiodipropionate, and the like compounds.

Phosphorus-containing Organic Compounds triphenylphosphine, tri(nonylphenyl)phosphine, tri(dinonylphenyl)phosphine, tricresylphosphine, tri(2,4-dibutylphenoxy)phosphine, and the like compounds.

These compounds are known as antioxidants for use in rubbers, plastics, and oils and fats, and are commercially available.

The content of the antioxidant in the photosensitive layer (or protective layer) is from 0.1 to 100 parts by weight, and preferably from 2 to 30 parts by weight, per 100 parts by weight of the charge transport material included in the layer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Photoreceptor 1

Preparation of Undercoat Layer

| The following components were mixed and dispersed to prepare an undercoat layer coating liquid. | |
|---|---|
| Alkyd resin (tradenamed as BEKKOZOL 1307-60-EL and manufactured by Dainippon Ink and Chemicals, Inc.) | 6 |
| Melamine resin (tradenamed as SUPER BEKKAMIN G-821-60 and manufactured by Dainippon Ink and Chemicals, Inc.) | 4 |
| Titanium oxide | 40 |
| Methyl ethyl ketone | 200 |

The undercoat layer coating liquid was coated on the surface of an aluminum drum having a diameter of 30 mm, and dried. Thus an undercoat layer having a thickness of 3.5 μm was prepared.

Preparation of Charge Generation Layer

The following components were mixed and dispersed to prepare a charge generation layer coating liquid.

| | |
|---|---|
| Trisazo pigment having the following formula | 2.5 |

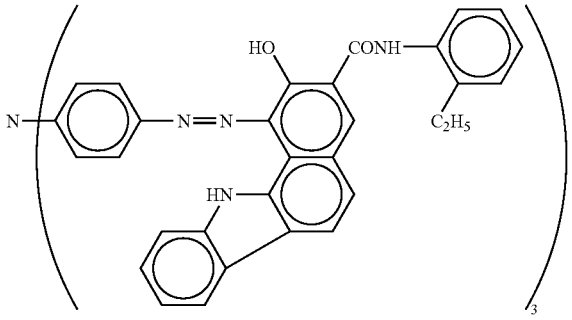

| | |
|---|---|
| Polyvinyl butyral (tradenamed as XYHL and manufactured by Union Carbide Corp.) | 0.25 |
| Cyclohexanone | 200 |
| Methyl ethyl ketone | 80 |

The charge generation layer coating liquid was coated on the undercoat layer and then dried. Thus a charge generation layer having a thickness of 0.2 μm was prepared.

Preparation of Charge Transport Layer

The following components were mixed and dispersed to prepare a charge transport layer coating liquid.

| | |
|---|---|
| Bisphenol A type polycarbonate resin (tradenamed as Panlite K1300 and manufactured by Teijin Ltd.) | 10 |
| Low molecular weight charge transport material having the following formula | 10 |

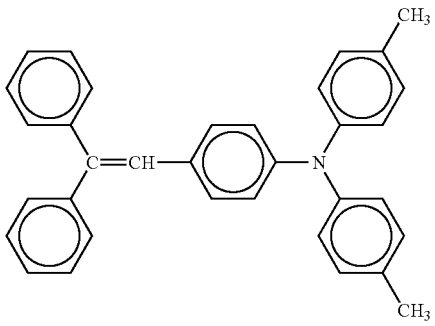

| | |
|---|---|
| Methylene chloride | 100 |

The charge transport layer coating liquid was coated on the charge generation layer and then dried. Thus a charge transport layer having a thickness of 25 μm was formed.

Thus a photoreceptor 1 was prepared.

Preparation of Photoreceptor 2

The procedure for preparation of the photoreceptor 1 was repeated except that the formulation of the charge generation layer coating liquid was changed to the following.

Charge Generation Layer Coating Liquid

The following-components were-mixed and dispersed using a ball mill.

| The following components were mixed and dispersed using a ball mill. | |
|---|---|
| Y-form oxotitanylphthalocyanine pigment | 2 |
| polyvinyl butyral resin (tradenamed as S-lec BM-S and manufactured by Sekisui Chemical Co., Ltd.) | 0.2 |
| Tetrahydrofuran | 50 |

Thus a photoreceptor 2 was prepared.

Preparation of Photoreceptor 3

The procedure for preparation of the photoreceptor 1 was repeated. In addition, the following protective layer coating liquid was prepared.

Protective Layer Coating Liquid

| | |
|---|---|
| Charge transport material having the following formula | 2 |

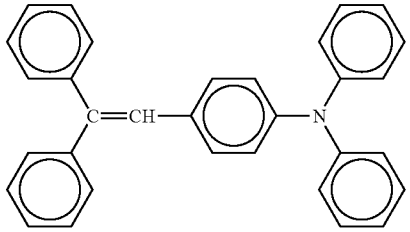

| | |
|---|---|
| A-form polycarbonate resin | 4 |
| Methylene chloride | 100 |

The protective layer coating liquid was coated on the charge transport layer and then dried. Thus a protective layer having a thickness of 2 μm was prepared.

Thus a photoreceptor 3 was prepared.

Preparation of Photoreceptor 4

The procedure for preparation of the photoreceptor 3 was repeated except that the formulation of the protective layer coating liquid was changed to the following.

Protective Layer Coating Liquid

| | |
|---|---|
| Charge transport material having the following formula | 4 |

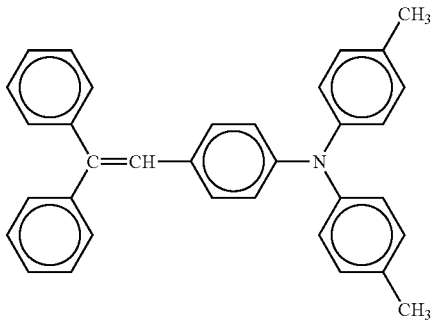

| | |
|---|---|
| A-form polycarbonate resin | 4 |
| Titanium oxide | 1 |
| Methylene chloride | 100 |

Thus a photoreceptor 4 was prepared.

Preparation of Photoreceptor 5

The procedure for preparation of the photoreceptor 4 was repeated except that the titanium oxide in the protective layer coating liquid was replaced with aluminum oxide.

Thus a photoreceptor 5 was prepared.

These photoreceptors 1 to 5 were evaluated as follows:

(1) Running Test

Each of the photoreceptors 1 to 5 was set in a digital copier as shown in FIG. 1, Imagio MF200 manufactured by Ricoh Co., Ltd., in which a lubricant applying device can be provided and the charging method can be changed, and a running test in which 200,000 copies were produced at the most. When a running test is started, the potential VD (i.e., the potential of the photoreceptor which was not exposed to imagewise light) was set so as to be 850 V, and the potential VL (i.e., the potential of the lighted photoreceptor) was set so as to be 120 V.

In the running test, the image qualities of the copies, and the friction coefficient and abrasion of the surface of the photosensitive layer were evaluated from time to time.

1) Image Qualities

The image quality of a copy image was evaluated while considering the image density, reproducibility of fine line images, and whether there were undesired images.

The image quality was graded as follows:

⊚: Excellent

○: Good

Δ1: Image density is slightly low

Δ2: A few small black streaks and slight background development are observed in the image Δ3: Slight tailing is observed in the image ×1: Image density is significantly low ×2: Black streaks and background development are observed in the image ×3: Tailing is observed in the image 2) Friction Coefficient The coefficient of static friction of the surface of the top layer (charge transport layer or protective layer) was measured by a method using an Euler belt.

Figure 9:
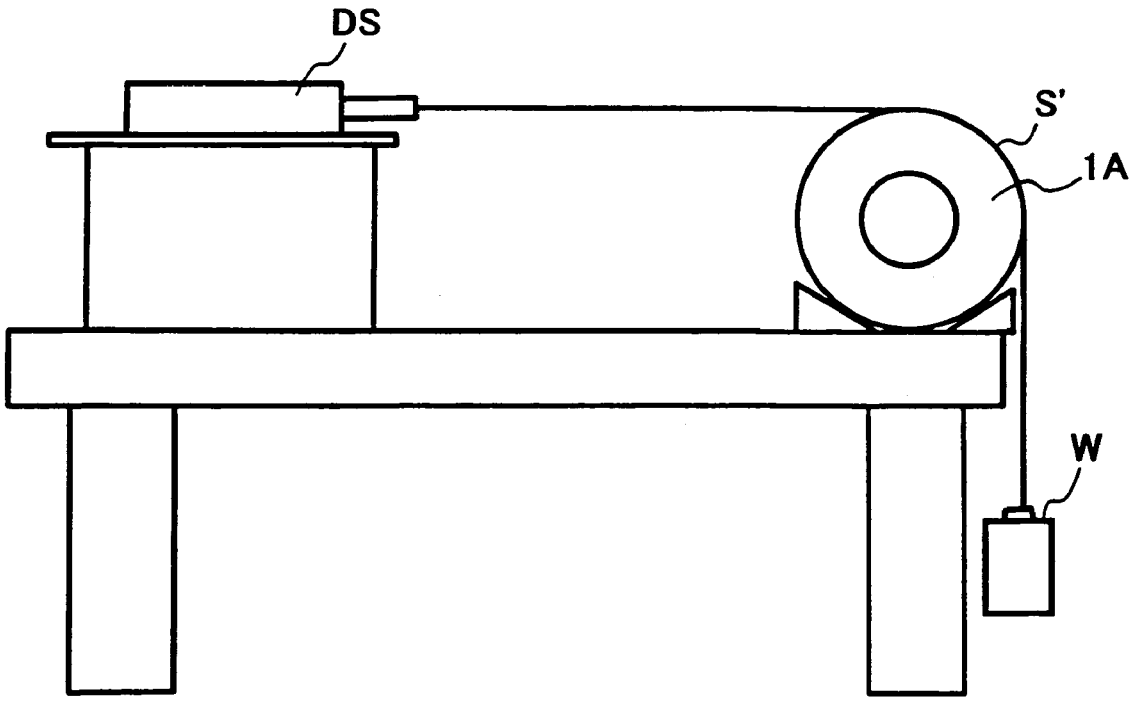
FIG. 9 is a schematic view illustrating an instrument for measuring friction coefficient of the surface of a photoreceptor using an Euler belt method.

The measuring instrument for use in the Euler belt method is shown in FIG. 9.

A character S' denotes a paper to be measured which have a middle thickness. Two hooks are set at each end of the paper S', and a load w (100 g) is set at one hook and a digital force gauge DS is set at the other hook. The paper S' is set in the measuring instrument so as to contact a photoreceptor 1A, as shown in FIG. 9. The paper S' is pulled with the digital force, gauge DS. Provided when a force at which the paper S' starts to move is F, the coefficient of static friction of the photoreceptor 1A is determined by the following equation:

$$\mu s=(\pi/2)ln(F/w)$$

wherein μs is the coefficient of static friction of the photoreceptor 1A, F is the measured value of the force, and w is the load (gram-force).

3) Amount of Abrasion.

The abrasion amount Δd of a photosensitive layer was determined by the following equation:

$$\Delta d=di-dl$$

Wherein di represents the total thickness of the photosensitive layer before the running test and dl represents the total thickness of the photosensitive layer after the running test.

(2) Amount of Nitrate Ion on the Surface of Photoreceptor

The concentration of nitrate ion adhered on the surface of a photoreceptor was measured by the following method:

(a) the surface of a photoreceptor is wiped with a non-woven fabric wetted with distilled water;

(b) then the non-woven fabric is dipped into distilled water and subjected to an ultrasonic vibration treatment to extract the materials adhered to the non-woven fabric therefrom;

(c) distilled water is added to the distilled water including the extracted materials such that the solution has a predetermined volume;

(d) the amount of nitrate ion in the solution is determined using an ion chromatograph apparatus (tradenamed as IC-7000P and manufactured by Yokogawa Electric Corp.); and (e) the amount of nitrate ion per a unit area (1 $m^2$) of the surface of the photoreceptor is determined.

(3) Fluorine/Carbon (F/C) Ratio

The F/C ratio of the surface of the photoreceptor, which relates to the amount of the lubricant (fluorine-containing material) present on the surface of the photoreceptor was determined by X-ray photoelectron spectroscopy (XPS). The measuring conditions were as follows:

Measuring instruments: Scanning X-ray photoelectron spectroscopic apparatus, Quantum 2000 manufactured by PHI X-ray source: Al Kα

Scanning area: 100 μm×100 μm (4) Zinc/Carbon (Zn/C) Ratio

The Zn/C ratio of the surface of the photoreceptor which relates to the amount of the lubricant (fatty acid zinc salt) present on the surface of the photoreceptor was determined by X-ray photoelectron spectroscopy (XPS). The measuring conditions were as follows:

Measuring instruments: Scanning X-ray photoelectron spectroscopic apparatus, Quantum 2000 manufactured by PHI X-ray source: Al Kα

Scanning area: 100 μm×100 μm

EXAMPLE 1

The photoreceptor 1 was set in the image forming apparatus (modified Imagio MF200) to perform the running test mentioned above. The image forming conditions were as follows:

Charging method: contact charging method using a roller and applying DC voltage

Cleaning element: cleaning blade (as shown in FIG. 1)

Lubricant applying device: not used

The results are shown in Table 1.

EXAMPLE 2

The procedure for the running test performed in Example 1 was repeated except that the photoreceptor 1 was replaced with the photoreceptor 2.

The results are also shown in Table 1.

EXAMPLE 3

The procedure for the running test performed in Example 1 was repeated except that the photoreceptor 1 was replaced with the photoreceptor 3.

The results are also shown in Table 1.

COMPARATIVE EXAMPLE 1

The procedure for the running test performed in Example 1 was repeated except that the cleaning blade was replaced with a cleaning brush using an electroconductive nylon fiber.

The results are also shown in Table 1.

COMPARATIVE EXAMPLE 2

The procedure for the running test performed in Comparative Example 1 was repeated except that the photoreceptor 1 was replaced with the photoreceptor 2.

The results are also shown in Table 1.

COMPARATIVE EXAMPLE 3

The procedure for the running test performed in Comparative Example 1 was repeated except that the photoreceptor 1 was replaced with the photoreceptor 3.

The results are also shown in Table 1.

COMPARATIVE EXAMPLE 4

The procedure for the running test performed in Example 1 was repeated except that a cleaning brush using a polyester fiber was additionally provided as the cleaning element in the image forming apparatus as shown in FIG. 1.

The results are also shown in Table 1.

COMPARATIVE EXAMPLE 5

The procedure for the running test performed in Comparative Example 4 was repeated except that the photoreceptor 1 was replaced with the photoreceptor 2.

EXAMPLE 4

The procedure for the running test performed in Example 1 was repeated except that the lubricant applying device as shown in FIG. 5 was provided in the image forming apparatus as shown in FIG. 1. The conditions of the lubricant applying device were as follows:

Lubricant: Polytetrafluoroethylene (PTFE)

Contact pressure of the lubricant 117: 30 g

The contact pressure was measured as follows:

(1) a paper sheet (RICOPY PPC paper TYPE 6200 sold by Ricoh Co., Ltd.) having a width of 30 mm is inserted between the element 117 and the photoreceptor 1; and (2) the paper sheet was pulled with a force gauge to measure the force by which the paper starts to be moved.

The results are also shown in Table 1.

EXAMPLE 5

The procedure for the running test performed in Example 4 was repeated except that the photoreceptor 1 was replaced with the photoreceptor 2.

The results are also shown in Table 1.

EXAMPLE 6

The procedure for the running test performed in Example 4 was repeated except that the photoreceptor 1 was replaced with the photoreceptor 3.

The results are also shown in Table 1.

EXAMPLE 6A

The procedure for the running test performed in Example 4 was repeated except that the contact pressure was changed to 5 g.

EXAMPLE 6B

The procedure for the running test performed in Comparative Example 6 was repeated except that the photoreceptor 1 was replaced with the photoreceptor 2.

COMPARATIVE EXAMPLE 6

The procedure for the running test performed in Example 4 was repeated except that the contact pressure was changed to 150 g.

COMPARATIVE EXAMPLE 7

The procedure for the running test performed in Comparative Example 8 was repeated except that the photoreceptor 1 was replaced with the photoreceptor 2.

EXAMPLE 7

The procedure for the running test performed in Example 1 was repeated except that the lubricant applying device as shown in FIG. 4 was provided in the image forming apparatus as shown in FIG. 1. The conditions of the lubricant applying device were as follows:

Lubricant: Polytetrafluoroethylene (PTFE)

Contact pressure of the lubricant 115: 10 g (The contact pressure was measured in the same method as mentioned in Example 4)

The results are also shown in Table 1.

EXAMPLE 8

The procedure for the running test performed in Example 7 was repeated except that the photoreceptor 1 was replaced with the photoreceptor 2.

The results are also shown in Table 1.

EXAMPLE 9

The procedure for the running test performed in Example 7 was repeated except that the photoreceptor 1 was replaced with the photoreceptor 3.

The results are also shown in Table 1.

EXAMPLE 10

The procedure for the running test performed in Example 7 was repeated except that the photoreceptor 1 was replaced with the photoreceptor 4.

The results are also shown in Table 1.

EXAMPLE 11

The procedure for the running test performed in Example 7 was repeated except that the photoreceptor 1 was replaced with the photoreceptor 5.

The results are also shown in Table 1.

COMPARATIVE EXAMPLE 11A

The procedure for the running test performed in Example 7 was repeated except that the contact pressure of the lubricant 115 was changed to 2 g.

COMPARATIVE EXAMPLE 11B

The procedure for the running test performed in Comparative Example 10 was repeated except that photoreceptor 1 was changed to the photoreceptor 2.

COMPARATIVE EXAMPLE 8

The procedure for the running test performed in Example 7 was repeated except that the contact pressure of the lubricant 115 was changed to 50 g.

COMPARATIVE EXAMPLE 9

The procedure for the running test performed in Comparative Example 12 was repeated except that photoreceptor 1 was changed to the photoreceptor 2.

EXAMPLE 12

The procedure for the running test performed in Example 1 was repeated except that the toner in the two component developer was changed to the following:

Toner: a zinc steatate powder was added to the toner in an amount of 0.05 parts per 1 part by weight of the toner The replenishing toner was also replaced with the toner mentioned above.

The results are also shown in Table 1.

EXAMPLE 13

The procedure for the running test performed in Example 12 was repeated except that the photoreceptor 1 was replaced with the photoreceptor 2.

The results are also shown in Table 1.

EXAMPLE 14

The procedure for the running test performed in Example 12 was repeated except that the photoreceptor 1 was replaced with the photoreceptor 3.

The results are also shown in Table 1.

EXAMPLE 15

The procedure for the running test performed in Example 12 was repeated except that the photoreceptor 1 was replaced with the photoreceptor 4.

The results are also shown in Table 1.

EXAMPLE 16

The procedure for the running test performed in Example 12 was repeated except that the photoreceptor 1 was replaced with the photoreceptor 5.

The results are also shown in Table 1.

COMPARATIVE EXAMPLE 10

The procedure for the running test performed in Example 12 was repeated except that the ratio of the zinc stearate to the toner was changed to 0.3/1 by weight.

EXAMPLE 17

The procedure for the running test performed in Example 1 was repeated except that the toner in the two component developer was changed to the following:

Toner: a zinc stearate powder was added to the toner in an amount of 0.3 parts per 1 part by weight of the toner The replenishing toner was also replaced with the toner mentioned above.

In addition, a cleaning brush using a polyester fiber was additionally provided to the cleaning unit.

The results are also shown in Table 1.

EXAMPLE 18

The procedure for the running test performed in Example 17 was repeated except that the photoreceptor 1 was replaced with the photoreceptor 3.

The results are also shown in Table 1.

EXAMPLE 19

The procedure for the running test performed in Example 17 was repeated except that the photoreceptor 1 was replaced with the photoreceptor 4.

The results are also shown in Table 1.

EXAMPLE 20

The procedure for the running test performed in Example 17 was repeated except that the photoreceptor 1 was replaced with the photoreceptor 5.

The results are also shown in Table 1.

EXAMPLE 21

The procedure for the running test performed in Example 17 was repeated except that the charging device was changed to the following short range charging device:

(1) A tape having a thickness of 50 μm was adhered on both sides of the photoreceptor 1 to form a gap between the photoreceptor 1 and the charging roller; and (2) A DC voltage of −750 V was applied to the charging roller while an AC voltage having a frequency of 1 KHz and a peak-to-peak voltage of 1.5 KV was overlapped.

The results are also shown in Table 1.

EXAMPLE 22

The procedure for the running test performed in Example 21 was repeated except that the photoreceptor 1 was replaced with the photoreceptor 3.

The results are also shown in Table 1.

EXAMPLE 23

The procedure for the running test performed in Example 21 was repeated except that the photoreceptor 1 was replaced with the photoreceptor 4.

The results are also shown in Table 1.

EXAMPLE 24

The procedure for the running test performed in Example 21 was repeated except that the photoreceptor 1 was replaced with the photoreceptor 5.

The results are also shown in Table 1.

TABLE 1

| | Nitrate ion ($\mu g/m^2$) | F/C ratio | Zn/C ratio | Abrasion ($\mu m$) | Image qualities |
|---|---|---|---|---|---|
| | Photoreceptor in an initial state | | | | |
| Ex. 1 | 50 | 0 | 0 | 0.0 | ◎ |
| Ex. 2 | 50 | 0 | 0 | 0.0 | ◎ |
| Ex. 3 | 50 | 0 | 0 | 0.0 | ◎ |
| Comp. Ex. 1 | 50 | 0 | 0 | 0.0 | ◎ |
| Comp. Ex. 2 | 50 | 0 | 0 | 0.0 | ◎ |
| Comp. Ex. 3 | 50 | 0 | 0 | 0.0 | ◎ |
| Comp. Ex. 4 | 50 | 0 | 0 | 0.0 | ◎ |
| Comp. Ex. 5 | 50 | 0 | 0 | 0.0 | ◎ |
| Ex. 4 | 50 | 0 | 0 | 0.0 | ◎ |
| Ex. 5 | 50 | 0 | 0 | 0.0 | ◎ |
| Ex. 6 | 50 | 0 | 0 | 0.0 | ◎ |
| Ex. 6A | 50 | 0 | 0 | 0.0 | ◎ |
| Ex. 6B | 50 | 0 | 0 | 0.0 | ◎ |
| Ex. 6 | 50 | 0 | 0 | 0.0 | ◎ |
| Comp. Ex. 7 | 50 | 0 | 0 | 0.0 | ◎ |
| Ex. 7 | 50 | 0 | 0 | 0.0 | ◎ |
| Ex. 8 | 50 | 0 | 0 | 0.0 | ◎ |
| Ex. 9 | 50 | 0 | 0 | 0.0 | ◎ |
| Ex. 10 | 50 | 0 | 0 | 0.0 | ◎ |
| Ex. 11 | 50 | 0 | 0 | 0.0 | ◎ |
| Ex. 11A | 50 | 0 | 0 | 0.0 | ◎ |
| Ex. 11B | 50 | 0 | 0 | 0.0 | ◎ |
| Comp. Ex. 8 | 50 | 0 | 0 | 0.0 | ◎ |
| Comp. Ex. 9 | 50 | 0 | 0 | 0.0 | ◎ |
| Ex. 12 | 50 | 0 | 0 | 0.0 | ◎ |
| Ex. 13 | 50 | 0 | 0 | 0.0 | ◎ |
| Ex. 14 | 50 | 0 | 0 | 0.0 | ◎ |
| Ex. 15 | 50 | 0 | 0 | 0.0 | ◎ |
| Ex. 16 | 50 | 0 | 0 | 0.0 | ◎ |
| Comp. Ex. 10 | 50 | 0 | 0 | 0.0 | ◎ |
| Ex. 17 | 50 | 0 | 0 | 0.0 | ◎ |
| Ex. 18 | 50 | 0 | 0 | 0.0 | ◎ |
| Ex. 19 | 50 | 0 | 0 | 0.0 | ◎ |
| Ex. 20 | 50 | 0 | 0 | 0.0 | ◎ |
| Ex. 21 | 50 | 0 | 0 | 0.0 | ◎ |
| Ex. 22 | 50 | 0 | 0 | 0.0 | ◎ |
| Ex. 23 | 50 | 0 | 0 | 0.0 | ◎ |
| Ex. 24 | 50 | 0 | 0 | 0.0 | ◎ |
| | Photoreceptor after 100,000 copies | | | | |
| Ex. 1 | 80 | 0.00 | 0.000 | 8.0 | ◎ |
| Ex. 2 | 70 | 0.00 | 0.000 | 7.0 | ◎ |
| Ex. 3 | 90 | 0.00 | 0.000 | 5.0 | ◎ |
| Comp. Ex. 1 | 350 | 0.00 | 0.000 | 0.2 | X3 |
| Comp. Ex. 2 | 350 | 0.00 | 0.000 | 0.2 | X3 |
| Comp. Ex. 3 | 360 | 0.00 | 0.000 | 0.2 | X3 |
| Comp. Ex. 4 | 30 | 0.00 | 0.000 | 12.0 | Δ2 |
| Comp. Ex. 5 | 30 | 0.00 | 0.000 | 13.0 | Δ2 |
| Ex. 4 | 150 | 0.25 | 0.000 | 1.0 | ◎ |
| Ex. 5 | 180 | 0.26 | 0.000 | 0.9 | ◎ |
| Ex. 6 | 200 | 0.27 | 0.000 | 0.6 | ◎ |
| Ex. 6A | 100 | 0.03 | 0.000 | 7.0 | ◎ |
| Ex. 6B | 80 | 0.03 | 0.000 | 7.0 | ◎ |
| Comp. Ex. 6 | 400 | 0.55 | 0.000 | 0.2 | X3 |
| Comp. Ex. 7 | 450 | 0.60 | 0.000 | 0.2 | X3 |
| Ex. 7 | 160 | 0.26 | 0.000 | 0.9 | ◎ |
| Ex. 8 | 160 | 0.26 | 0.000 | 1.0 | ◎ |
| Ex. 9 | 150 | 0.25 | 0.000 | 0.7 | ◎ |
| Ex. 10 | 180 | 0.27 | 0.000 | 0.2 | ◎ |
| Ex. 11 | 170 | 0.26 | 0.000 | 0.2 | ◎ |
| Ex. 11A | 80 | 0.03 | 0.000 | 8.0 | ◎ |
| Ex. 11B | 70 | 0.03 | 0.000 | 7.0 | ◎ |
| Comp. Ex. 8 | 500 | 0.60 | 0.000 | 0.2 | X3 |
| Comp. (C). 9 | 550 | 0.62 | 0.000 | 0.2 | X3 |
| Ex. 12 | 60 | 0.00 | 0.002 | 1.8 | ◎ |

TABLE 1-continued

| | Nitrate ion ($\mu g/m^2$) | F/C ratio | Zn/C ratio | Abrasion ($\mu m$) | Image qualities |
|---|---|---|---|---|---|
| Ex. 13 | 70 | 0.00 | 0.002 | 1.9 | ◎ |
| Ex. 14 | 80 | 0.00 | 0.005 | 0.9 | ◎ |
| Ex. 15 | 140 | 0.00 | 0.050 | 0.2 | ◎ |
| Ex. 16 | 150 | 0.00 | 0.050 | 0.2 | ◎ |
| Comp. Ex. 10 | 580 | 0.00 | 0.150 | 0.1 | X3 |
| Ex. 17 | 160 | 0.00 | 0.040 | 0.9 | ◎ |
| Ex. 18 | 180 | 0.00 | 0.050 | 0.5 | ◎ |
| Ex. 19 | 200 | 0.00 | 0.060 | 0.2 | ◎ |
| Ex. 20 | 210 | 0.00 | 0.060 | 0.2 | ◎ |
| Ex. 21 | 220 | 0.00 | 0.040 | 1.2 | ◎ |
| Ex. 22 | 240 | 0.00 | 0.050 | 0.6 | ◎ |
| Ex. 23 | 250 | 0.00 | 0.060 | 0.2 | ◎ |
| Ex. 24 | 250 | 0.00 | 0.060 | 0.2 | ◎ |
| | Photoreceptor after 200,000 copies | | | | |
| Ex. 1 | 80 | 0.00 | 0.000 | 15.0 | Δ2 |
| Ex. 2 | 80 | 0.00 | 0.000 | 14.0 | Δ2 |
| Ex. 3 | 95 | 0.00 | 0.000 | 12.0 | Δ2 |
| Comp. Ex. 1 | 450 | 0.00 | 0.000 | 0.5 | X3 |
| Comp. Ex. 2 | 470 | 0.00 | 0.000 | 0.4 | X3 |
| Comp. Ex. 3 | 480 | 0.00 | 0.000 | 0.3 | X3 |
| Comp. Ex. 4 | 30 | 0.00 | 0.000 | 23.0 | X3 |
| Comp. Ex. 5 | 30 | 0.00 | 0.000 | 24.0 | X3 |
| Ex. 4 | 200 | 0.28 | 0.000 | 2.0 | ◎ |
| Ex. 5 | 220 | 0.29 | 0.000 | 2.0 | ◎ |
| Ex. 6 | 250 | 0.29 | 0.000 | 1.8 | ◎ |
| Ex. 6A | 120 | 0.03 | 0.000 | 13.0 | Δ2 |
| Ex. 6B | 100 | 0.03 | 0.000 | 13.0 | Δ2 |
| Comp. Ex. 6 | 500 | 0.60 | 0.000 | 0.6 | X3 |
| Comp. Ex. 7 | 550 | 0.62 | 0.000 | 0.5 | X3 |
| Ex. 7 | 180 | 0.28 | 0.000 | 2.0 | ◎ |
| Ex. 8 | 200 | 0.27 | 0.000 | 2.2 | ◎ |
| Ex. 9 | 210 | 0.28 | 0.000 | 1.6 | ◎ |
| Ex. 10 | 220 | 0.27 | 0.000 | 0.5 | ◎ |
| Ex. 11 | 200 | 0.27 | 0.000 | 0.5 | ◎ |
| Ex. 11A | 100 | 0.03 | 0.000 | 15.0 | Δ2 |
| Ex. 11B | 90 | 0.03 | 0.000 | 15.0 | Δ2 |
| Comp. Ex. 8 | 580 | 0.64 | 0.000 | 0.5 | X3 |
| Comp. Ex. 9 | 600 | 0.62 | 0.000 | 0.4 | X3 |
| Ex. 12 | 80 | 0.00 | 0.002 | 3.8 | ◎ |
| Ex. 13 | 90 | 0.00 | 0.002 | 4.0 | ◎ |
| Ex. 14 | 100 | 0.00 | 0.006 | 1.9 | ◎ |
| Ex. 15 | 180 | 0.00 | 0.060 | 0.4 | ◎ |
| Ex. 16 | 200 | 0.00 | 0.050 | 0.5 | ◎ |
| Comp. Ex. 10 | 620 | 0.00 | 0.180 | 0.2 | X3 |
| Ex. 17 | 200 | 0.00 | 0.050 | 1.9 | ◎ |
| Ex. 18 | 220 | 0.00 | 0.050 | 1.1 | ◎ |
| Ex. 19 | 250 | 0.00 | 0.060 | 0.3 | ◎ |
| Ex. 20 | 230 | 0.00 | 0.050 | 0.4 | ◎ |
| Ex. 21 | 240 | 0.00 | 0.050 | 2.2 | ◎ |
| Ex. 22 | 250 | 0.00 | 0.050 | 1.5 | ◎ |
| Ex. 23 | 270 | 0.00 | 0.060 | 0.4 | ◎ |
| Ex. 24 | 280 | 0.00 | 0.060 | 0.4 | ◎ |

As can be understood from Table 1, the photoreceptors and image forming apparatus of the present invention can produce images having good image qualities with little abrasion even when used for a long time. On the contrary, the comparative photoreceptor and image forming apparatus have at least one of the drawbacks of large abrasion and producing undesired images such as black streaks, background development, and tailing. Therefore, the comparative photoreceptors and image forming apparatus are apparently inferior to the photoreceptors and image forming apparatus of the present invention.

This document claims priority and contains subject matter related to Japanese Patent Applications Nos. 2000-057342 and 2001-018537, filed on Mar. 2, 2000 and Jan. 26, 2001, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of operating an image forming apparatus comprising controlling nitrate ion present on a surface of a photosensitive layer on an electroconductive substrate of an electrophotographic photoreceptor of said image forming apparatus in an amount of from 50 to 300 $\mu g/m^2$ during production of electrophotographic copies by said apparatus, wherein said controlling includes measuring the amount of nitrate ion present on said surface.

2. The method according to claim 1, wherein a material comprising a fluorine atom and a carbon atom is further present on the surface of the photosensitive layer.

3. The method according to claim 2, wherein a ratio of the number of fluorine atoms to the number of carbon atoms at the surface of the photosensitive layer is from 0.05 to 0.5.

4. The method according to claim 2, wherein the material comprises polytetrafluoroethylene.

5. The method according to claim 1, wherein a fatty acid metal salt is further present on the surface of the photosensitive layer.

6. The method according to claim 5, wherein the fatty acid metal salt comprises a zinc atom.

7. The method according to claim 6, wherein the fatty acid metal salt is zinc stearate.

8. The method according to claim 6, wherein a ratio of the number of zinc atoms to the number of carbon atoms at the surface of the photosensitive layer is from 0.001 to 0.1.

9. The method according to claim 1, wherein the photoreceptor further comprises a protective layer as a surface layer, and wherein the protective layer comprises a resin.

10. The method according to claim 9, wherein the protective layer further comprises a filler.

11. The method according to claim 9, wherein the protective layer further comprises a charge transport material.

12. The method according to claim 1, wherein the image forming apparatus comprises, in addition to the electrophotographic photoreceptor:

a charger configured to charge the electrophotographic photoreceptor;

a light irradiator configured to irradiate the photoreceptor with light to form an electrostatic latent image on the electrophotographic photoreceptor;

an image developer configured to develop the electrostatic latent image with a developer comprising a toner to form a toner image on the electrophotographic photoreceptor a transfer configured to transfer the toner image onto a receiving material; and a fixer configured to fix the toner image on the receiving material.

13. The method according to claim 12, wherein the image forming apparatus further comprises a lubricant applicator configured to apply a lubricant on the surface of the photosensitive layer.

14. The method according to claim 13, wherein the lubricant comprises a fluorine atom and a carbon atom, and wherein a ratio of the number of fluorine atoms to the number of carbon atoms at the surface of the photosensitive layer is from 0.05 to 0.5.

15. The method according to claim 13, wherein the lubricant comprises a fluorine-containing resin.

16. The method according to claim 15, wherein the fluorine-containing resin is polytetrafluoroethylene.

17. The method according to claim 13, wherein the lubricant comprises a fatty acid metal salt.

18. The method according to claim 17, wherein the fatty acid metal salt comprises a zinc atom.

19. The method according to claim 18, wherein the fatty acid metal salt is zinc stearate.

20. The method according to claim 18, wherein a ratio of the number of zinc atoms to the number of carbon atoms at the surface of the photosensitive layer is from 0.001 to 0.1.

21. The method according to claim 12, wherein the electrophotographic photoreceptor further comprises a protective layer as a surface layer of the photoreceptor, and wherein the protective layer comprises a resin.

22. The method according to claim 21, wherein the protective layer further comprises a filler.

23. The method according to claim 21, wherein the protective layer further comprises a charge transport material.

24. The method according to claim 12, wherein the developer further comprises a lubricant.

25. The method according to claim 24, wherein the image forming apparatus further comprises a container comprising a replenishing toner and the lubricant included in the developer.

26. The method according to claim 24, wherein the lubricant included in the developer comprises zinc stearate.

27. The method according to claim 12, wherein the light irradiator irradiates a light beam which has a diameter not greater than 50 μm and which is modulated by image information.

28. The method according to claim 12, wherein the charger comprises one of a contact charger or a short range charger.

29. The method according to claim 28, wherein the charger charges the photoreceptor while applying a DC voltage which is overlapped with an AC voltage.

30. The method according to claim 1, wherein said controlling is carried out during production of 100,000 electrophotographic copies by said apparatus.

31. The method according to claim 1, wherein said controlling is carried out during production of 200,000 electrophotographic copies by said apparatus.

32. The method according to claim 1, wherein the photosensitive layer excludes amorphous silicon.

33. The method according to claim 1, wherein the photosensitive layer includes an organic photosensitive material.

* * * * *